US012221313B2

(12) United States Patent
Tessier et al.

(10) Patent No.: US 12,221,313 B2
(45) Date of Patent: Feb. 11, 2025

(54) INTERLOCKED PAY OFF REEL DESIGN

(71) Applicant: Leviton Manufacturing Co., Inc., Melville, NY (US)

(72) Inventors: Ronald J L Tessier, Lititz, PA (US); Ross Goldman, Bothell, WA (US); John R. Weit, Jr., Stevens, PA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 444 days.

(21) Appl. No.: 17/682,455

(22) Filed: Feb. 28, 2022

(65) Prior Publication Data

US 2023/0271805 A1 Aug. 31, 2023

(51) Int. Cl.
*B65H 75/22* (2006.01)
*B65H 49/32* (2006.01)

(52) U.S. Cl.
CPC ..... *B65H 49/322* (2013.01); *B65H 49/325* (2013.01); *B65H 75/22* (2013.01)

(58) Field of Classification Search
CPC .... B65H 75/22; B65H 75/2236; B65H 49/36; B65H 49/321; B65H 49/322; B65H 49/325; B65H 49/328
See application file for complete search history.

(56) References Cited

U.S. PATENT DOCUMENTS 1,861,294 A 5/1932 Bartlett
2,393,613 A 1/1946 Combs
4,253,570 A 3/1981 O'Connor et al.
5,695,148 A 12/1997 Christensen
6,467,623 B1 10/2002 Lewis et al.
6,758,314 B2 7/2004 Woodruff
(Continued)

FOREIGN PATENT DOCUMENTS

CH 701475 B1 1/2011
EP 1688369 B1 2/2005
(Continued)

OTHER PUBLICATIONS

Extended European Search Report received for European Application No. 19306115.7 dated Feb. 14, 2020, 11 pages.
(Continued)

*Primary Examiner* — Sang K Kim
(74) *Attorney, Agent, or Firm* — Amin, Turocy & Watson, LLP

(57) ABSTRACT

An interlocked pay off reel comprises square or rectangular endplates that can be interlocked together to build a wall or skid of reels, and which allows the cable to be unspooled or paid out easily using a simple assembly. The pay off reel comprises two round flanges configured to hold respective ends of a cable spool. The flanges can be snapped to respective two square endplates, which elevate the spool and act as a stable base. The engagement mechanism between the flanges and the endplates permits the spool and flanges to rotate during pay off and applies frictional braking to prevent the spool from back spinning and freewheeling. Handles are built into the endplates so that the reel can be handled and moved easily. Interlock mechanisms on multiple sides and surfaces of the endplates permit the endplates to be locked to other endplates in all directions, allowing stacks of reels to be assembled.

20 Claims, 27 Drawing Sheets

(56) References Cited

U.S. PATENT DOCUMENTS

| | | | | |
|---|---|---|---|---|
| 6,991,197 | B2 | 1/2006 | Cox et al. | |
| 7,252,193 | B1 | 8/2007 | Lewis et al. | |
| 7,714,227 | B2 | 5/2010 | Sparrowhawk et al. | |
| 8,074,916 | B2 | 12/2011 | Penumatcha et al. | |
| 8,349,242 | B2 | 1/2013 | Cox et al. | |
| 8,480,023 | B2 | 7/2013 | Penumatcha et al. | |
| 8,770,510 | B2 | 7/2014 | Cox et al. | |
| 8,998,121 | B2 | 4/2015 | Davis et al. | |
| 9,126,800 | B2 | 9/2015 | Penumatcha | |
| 9,290,358 | B2 | 3/2016 | Sparrowhawk | |
| 9,494,757 | B2 | 11/2016 | Schomisch | |
| 9,695,008 | B2 * | 7/2017 | Thakare | B65H 49/305 |
| 9,862,566 | B2 * | 1/2018 | Thakare | B65H 49/305 |
| 9,873,588 | B2 * | 1/2018 | Thakare | B65H 75/2281 |
| 9,969,596 | B2 | 5/2018 | Cox et al. | |
| 10,589,957 | B2 * | 3/2020 | Thakare | B65H 75/14 |
| 10,611,598 | B2 * | 4/2020 | Thakare | B65H 49/205 |
| 10,696,514 | B2 | 6/2020 | Good | |
| 10,906,770 | B2 * | 2/2021 | Thakare | B65H 75/229 |
| 10,906,771 | B2 * | 2/2021 | Thakare | B65H 75/14 |
| 2002/0074462 | A1 | 6/2002 | Pontecorvo | |
| 2002/0125161 | A1 | 9/2002 | Cote | |
| 2003/0230667 | A1 | 12/2003 | Ganster | |
| 2006/0273217 | A1 | 12/2006 | Wilkinson | |
| 2008/0023579 | A1 | 1/2008 | Leonard et al. | |
| 2008/0093187 | A1 | 4/2008 | Roberts et al. | |
| 2008/0191436 | A1 | 8/2008 | Galgano et al. | |
| 2009/0230228 | A1 | 9/2009 | Penumatcha et al. | |
| 2010/0090049 | A1 | 4/2010 | Weissbrod | |
| 2010/0243784 | A1 | 9/2010 | Johanson et al. | |
| 2011/0101148 | A1 | 5/2011 | Allwood | |
| 2012/0153069 | A1 | 6/2012 | Allwood | |
| 2013/0075522 | A1 | 3/2013 | Penumatcha | |
| 2014/0001305 | A1 | 1/2014 | Penumatcha et al. | |
| 2014/0161411 | A1 | 6/2014 | Slater et al. | |
| 2015/0043882 | A1 | 2/2015 | Schomisch et al. | |
| 2016/0251196 | A1 | 9/2016 | Thakare et al. | |

FOREIGN PATENT DOCUMENTS

| | | | |
|---|---|---|---|
| EP | 2264502 | A1 | 12/2010 |
| EP | 3632827 | A1 | 4/2020 |
| FR | 2814246 | A1 | 3/2002 |
| JP | 2003029053 | A | 1/2003 |
| WO | 2013014226 | A1 | 1/2013 |
| WO | 2015086043 | A1 | 6/2015 |

OTHER PUBLICATIONS

"N'Roll Classic" Nexans; generated on Apr. 13, 2022. (2 pages).
"End~Stands for Boxed Reel Packaging" Reel Options, Vandor Corporation Product Catalog p. 8 (2019).
"Airbox" Axjo web accessed on May 27, 2022: https://www.axjo.com/products/special-solutions/airbox/ (4 pages).
"Mobiway system" Nexans Generated Nov. 19, 2021 (2 pages).
International Search Report and Written Opinion received for PCT Application Serial No. PCT/US2023/061833 dated May 10, 2023, 13 pages.

* cited by examiner

INTERLOCKED PAY OFF REEL DESIGN

TECHNICAL FIELD

The disclosed subject matter relates generally to cable spool retainment and management.

BACKGROUND

Many types of cables, including power and data cables, are provided to consumers on pay off reels or spools for compact storage. A typical pay off reel comprises a cylindrical core mounted between two round endplates, with the cable wound around the core.

However, the design of these pay off reels prevents the reels from being stacked on a transportation skid in a stable manner. Moreover, the cable cannot be easily unwound from the reel unless the reel is elevated and permitted to spin freely about an axis, which requires the cable installer to assemble a suitable pay off mechanism before use. Although some cable reels are provided in a box with internal pay off devices that elevate the reel to permit pay off, these cable reel systems require a considerable amount of manual assembly before shipping to an end user (e.g., manual installation of the reel and its pay off devices within the box) and are not stable without the box to hold the assembly.

The above-described deficiencies of cable reels are merely intended to provide an overview of some of the problems of current technology and are not intended to be exhaustive. Other problems with the state of the art, and corresponding benefits of some of the various non-limiting embodiments described herein, may become further apparent upon review of the following detailed description.

SUMMARY

The following presents a simplified summary of the disclosed subject matter in order to provide a basic understanding of some aspects of the various embodiments. This summary is not an extensive overview of the various embodiments. It is intended neither to identify key or critical elements of the various embodiments nor to delineate the scope of the various embodiments. Its sole purpose is to present some concepts of the disclosure in a streamlined form as a prelude to the more detailed description that is presented later.

Various embodiments described herein provide an interlocked pay off reel comprising square or rectangular endplates that can be interlocked together to build a wall or skid of reels, and which allows cable to be unspooled or paid off easily using a simple assembly. The pay off reel comprises two round flanges configured to hold respective ends of a core around which cable is wound. The round flanges can be snapped to respective two square endplates, which elevate the core and act as a stable base as the cable is being pulled during pay off. An engagement mechanism between the flanges and the square endplates permits the core and flanges to rotate during pay off while the square endplates stabilize the reel. The engagement mechanism uses friction as a braking mechanism to prevent the reel from back spinning and freewheeling. Handles are built into the square endplates so that the reel can be handled and moved easily. Interlock mechanisms are formed on multiple sides and surfaces of the square endplates to permit the reels to be securely connected to other reels in three directions, allowing two-dimensional or three-dimensional stacks of reels to be assembled.

To the accomplishment of the foregoing and related ends, the disclosed subject matter, then, comprises one or more of the features hereinafter more fully described. The following description and the annexed drawings set forth in detail certain illustrative aspects of the subject matter. However, these aspects are indicative of but a few of the various ways in which the principles of the subject matter can be employed. Other aspects, advantages, and novel features of the disclosed subject matter will become apparent from the following detailed description when considered in conjunction with the drawings. It will also be appreciated that the detailed description may include additional or alternative embodiments beyond those described in this summary.

DETAILED DESCRIPTION

Figure 1:
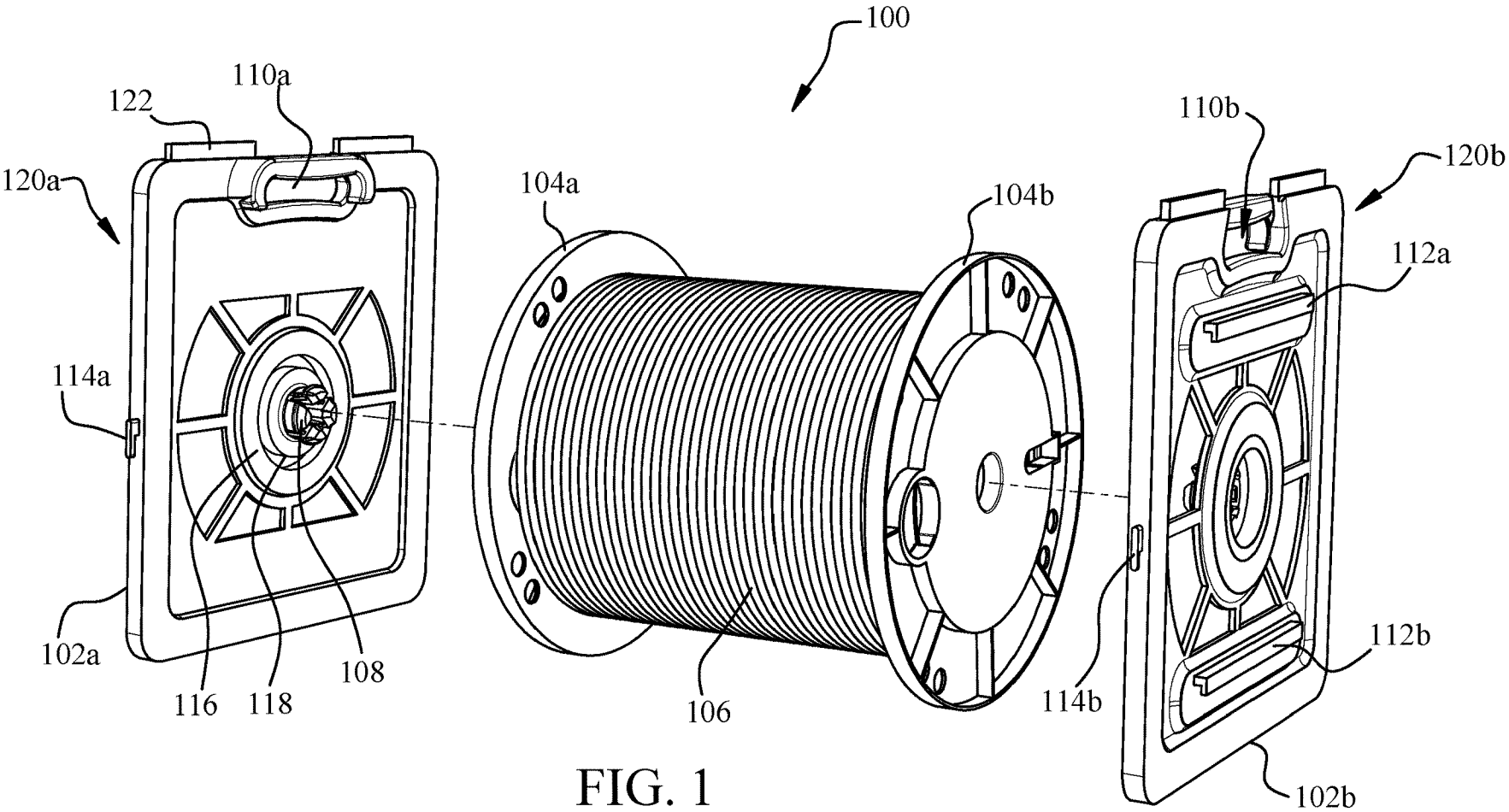
FIG. 1 is a perspective view of an example interlockable pay off reel with its primary components disassembled.

The subject disclosure is now described with reference to the drawings wherein like reference numerals are used to refer to like elements throughout. In the following description, for purposes of explanation, numerous specific details are set forth in order to provide a thorough understanding of the subject disclosure. It may be evident, however, that the subject disclosure may be practiced without these specific details. In other instances, well-known structures and devices are shown in block diagram form in order to facilitate describing the subject disclosure.

Figure 2:
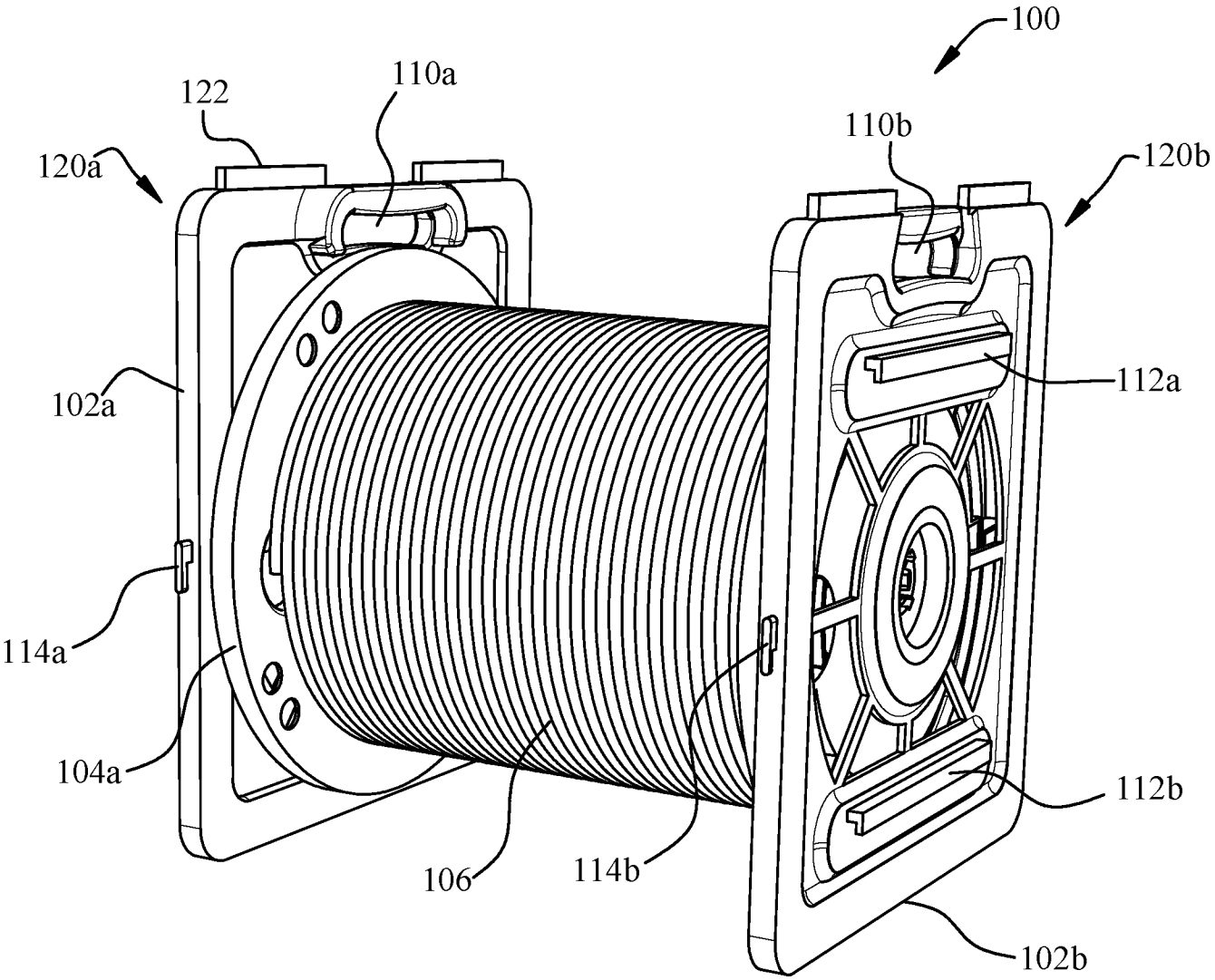
FIG. 2 as a perspective view of the pay off reel in assembled form.

FIG. 1 is a perspective view of an example interlockable pay off reel 100 with its primary components disassembled, and FIG. 2 as a perspective view of the pay off reel 100 in assembled form. Pay off reel 100 comprises two round flanges 104*a* and 104*b* designed to hold two respective ends of a cable spool 106 comprising a hollow cylindrical core (e.g., a cardboard tube, not visible in FIGS. 1 and 2) around which a length of cable is wound. Although the examples illustrated herein depict round flanges 104, the flanges 104 may be another shape without departing from the scope of one or more embodiments.

The flanges 104*a*, 104*b* are also configured to engage with respective square endplates 102*a* and 102*b*. As shown in FIG. 2, the square endplates 102*a*, 102*b* elevate the flanges 104*a*, 104*b* and the cable spool 106 off of the ground while the bottom edges of the endplates 102*a*, 102*b* are placed on the ground. As will be described in more detail below, the flanges 104*a*, 104*b* engage with the endplates 102*a*, 102*b* using a mechanism that permits the cable spool 106 to rotate while also providing frictional resistance to prevent excessive freewheeling of the spool 106.

Figure 3B:
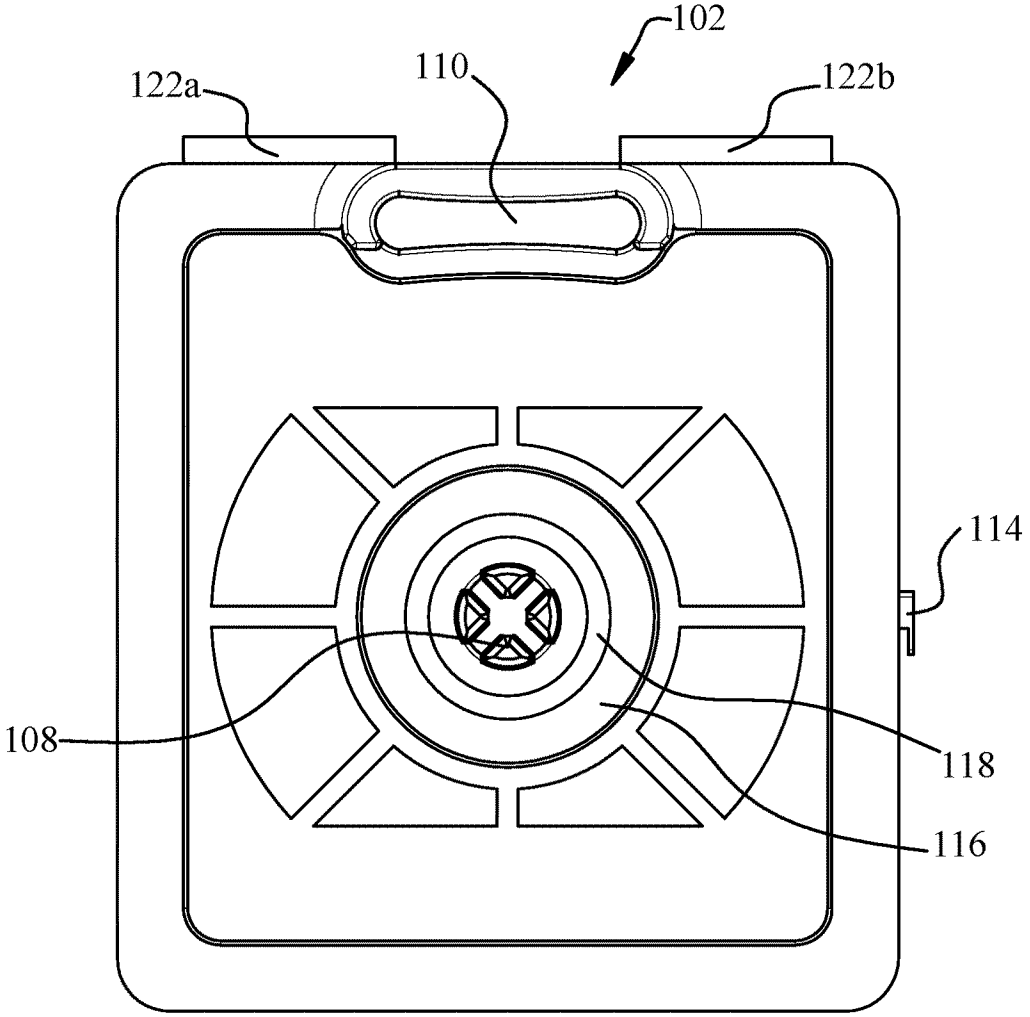
FIG. 3*b* a front view of an example endplate.
Figure 3A:
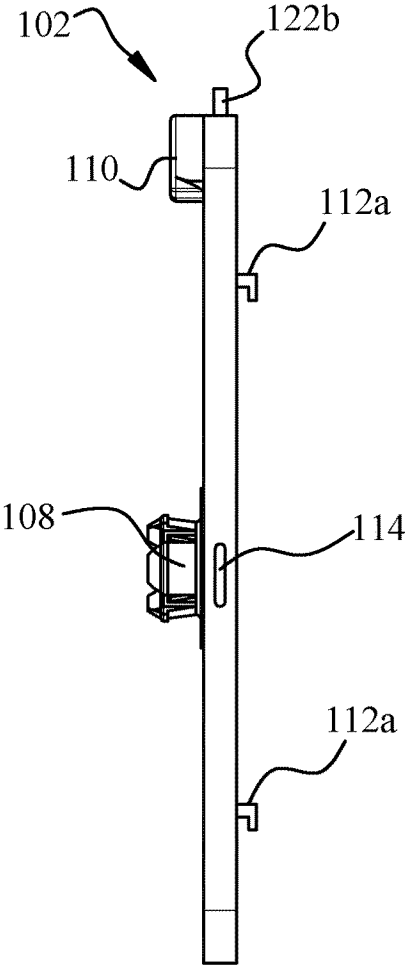
FIG. 3*a* a side view of an example endplate.
Figure 3C:
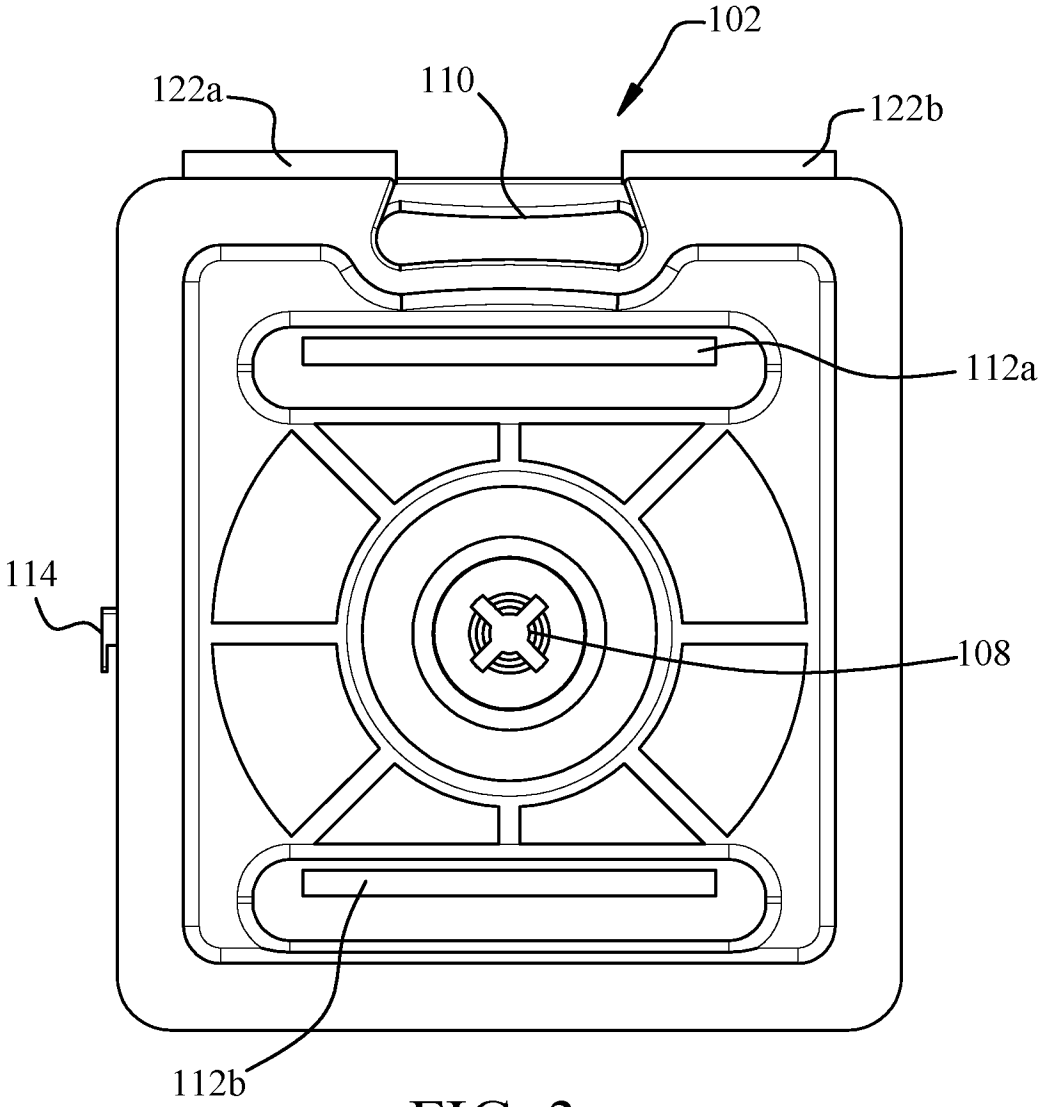
FIG. 3*c* a rear view of an example endplate.

FIGS. 3*a*-3*c* are a side view, a front view, and a rear view, respectively, of an example endplate 102. Endplate 102 has a substantially square or rectangular profile and is made of a rigid material capable of supporting a cable spool 106 (e.g., rigid plastic or another such material). A handle 110 is formed near a top edge of the endplate 102. A round raised area 116 is formed in a middle section of the front side of the endplate 102, and a circular groove 118 is formed within the raised area 116. A flange engagement mechanism 108 is formed on the surface of the raised area 116. This flange engagement mechanism 108 is configured to engage with a flange 104, as will be described in more detail below.

To facilitate interlocking the endplate 102 with other endplates 102, an engagement pin 114 is formed on a first side edge of the endplate 102 (that is, an edge adjacent to the top edge on which the handle 110 is formed) and an engagement receptacle 1302 (not visible in FIGS. 3*a*-3*c*; see FIG. 13) is formed on the opposing edge. The engagement pin 114 of one endplate 102 is configured to engage with the engagement receptacle 1302 of another endplate 102 to facilitate front-to-rear interlocking of pay off reels 100. Additionally, to facilitate side-to-side interlocking of pay off reels 100, two elongated engagement hooks 112*a* and 112*b* are formed on the rear side of the endplate 102, as shown in FIG. 3*c*. Also, two locking tabs 122 are formed on the top edge of the endplate 102, which are configured to engage with corresponding slots 1902 formed on the bottom edge of the endplate 102 (not visible in FIGS. 3*a*-3*c*; see FIG. 19) to stabilize top-to-bottom stacking of the pay off reels 100. These engagement features will be described in more detail below.

Figure 4A:
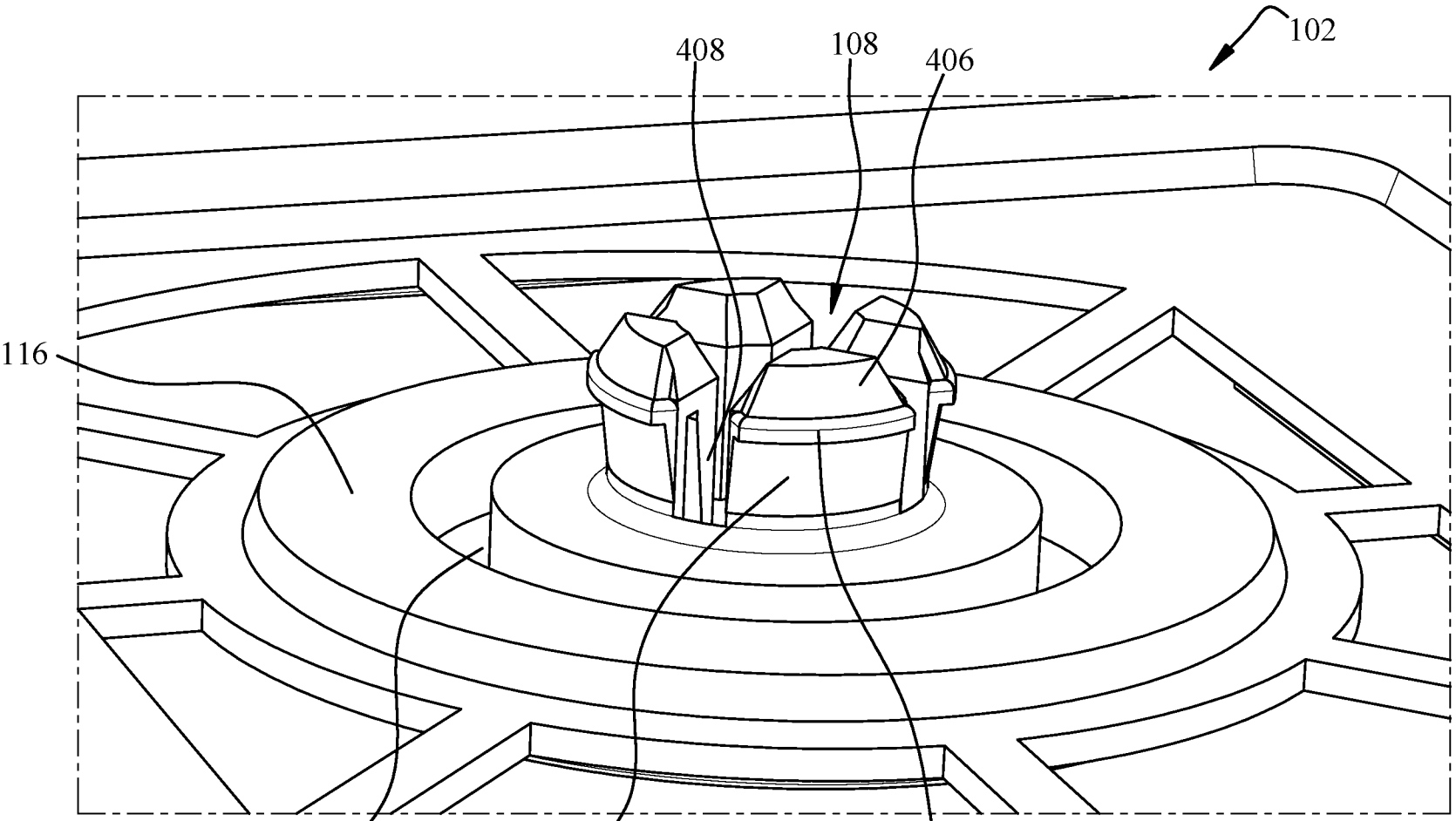
FIG. 4*a* is a close-up view of a flange engagement mechanism as seen from the front side of the endplate.
Figure 4B:
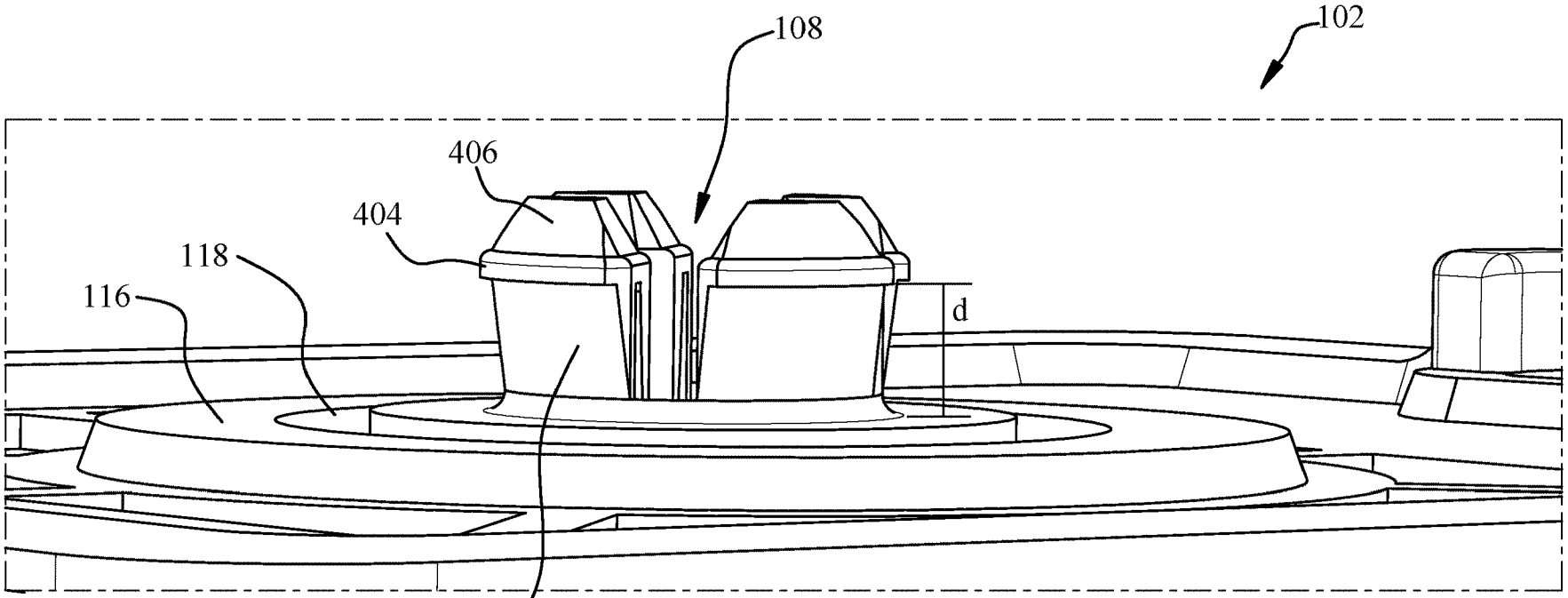
FIG. 4*b* is another close-up view of the flange engagement mechanism as seen from the front side of the endplate.

FIGS. 4*a* and 4*b* are two close-up views of the flange engagement mechanism 108 as seen from the front side of the endplate 102. In one or more embodiments, the flange engagement mechanism 108 can comprise a set of flexible pins 402 arranged in a circular formation and formed on the raised area 116. Although the illustrated embodiments depict the engagement mechanism 108 as comprising four flexible pins 402, the engagement mechanism 108 may comprise more or fewer such pins 402 in various embodiments. The flexible pins 402 are formed on the raised area 116 that is bounded by the circular groove 118. In their resting or unflexed states, the flexible pins 402 are angled outward (away from the center of the flange engagement mechanism 108) as shown in FIG. 4*b*. A raised ridge 404 or lip is formed on an outward-facing surface of each flexible pin 402, and a portion of each flexible pin 402 above this raised ridge 404 has an outward facing surface 406 that slants inward toward the center of the flange engagement mechanism 108.

Figure 5:
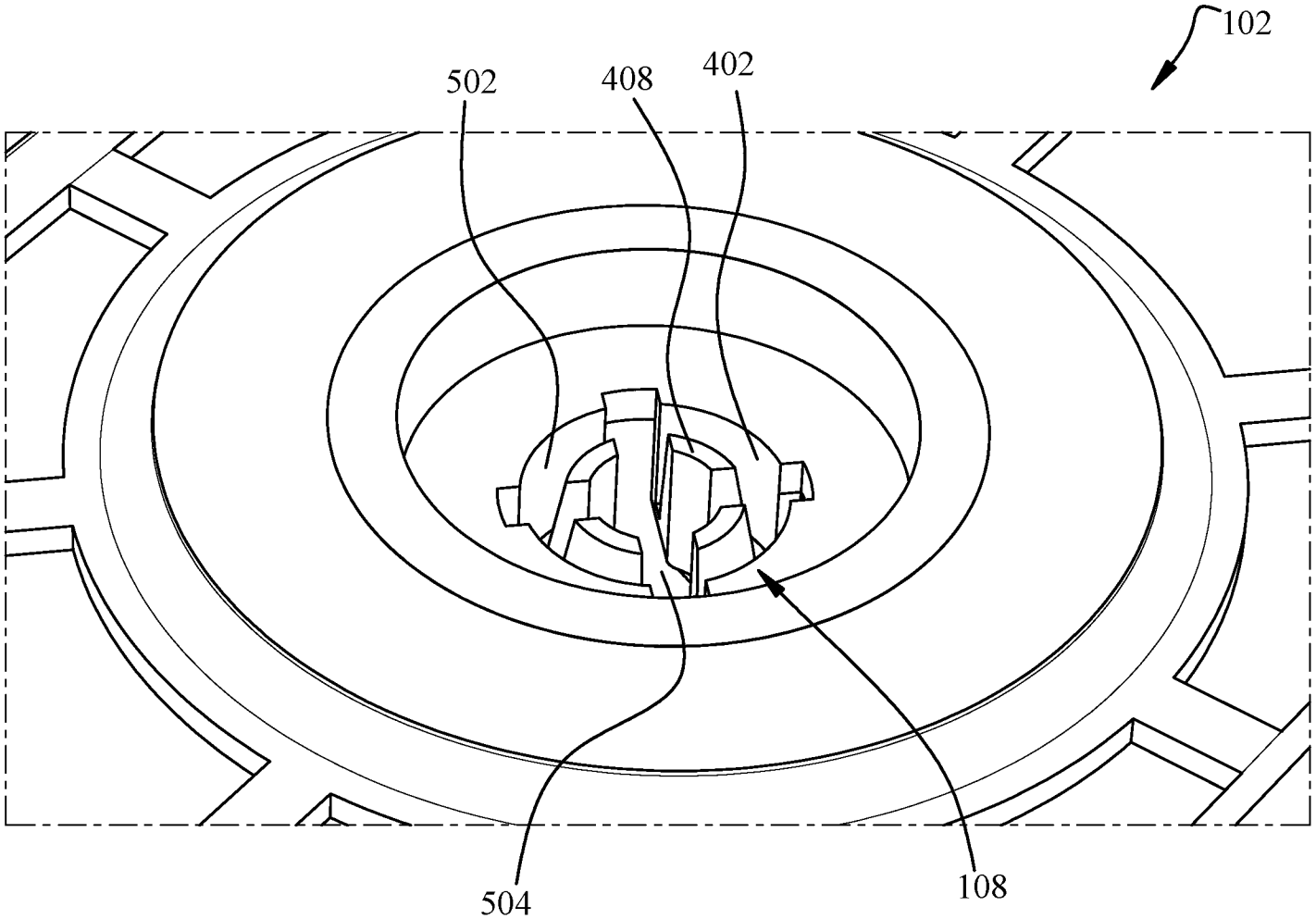
FIG. 5 is a close-up view of the flange engagement mechanism as seen from the rear side of the endplate.

As shown in FIG. 4*a*, the inward-facing side of each flexible pin 402—that is, the portion of the pin 402 facing toward the center of the flange engagement mechanism 108—comprises a downward-facing tongue 408; that is, a tongue 408 that projects from a center-facing corner of the pin 402 toward the rear side of the endplate 102. FIG. 5 is a close-up view of the flange engagement mechanism 108 as seen from the rear side of the endplate 102, which allows the bottoms of the tongues 408 to be seen. Viewed from the rear side of the endplate 102, the tongues 408 are arranged in a substantially circular formation. The spaces between the tongues 408 and their corresponding pins 402 collectively define a substantially circular gap 502 into which a disassembly tool can be inserted, as will be described in more detail below. The spaces 504 between adjacent tongues 408 permit the tongues 408 to be pulled inward toward the center of the flange engagement mechanism 108, which causes the flexible pins 402 to also be retracted toward the center.

Figure 6:
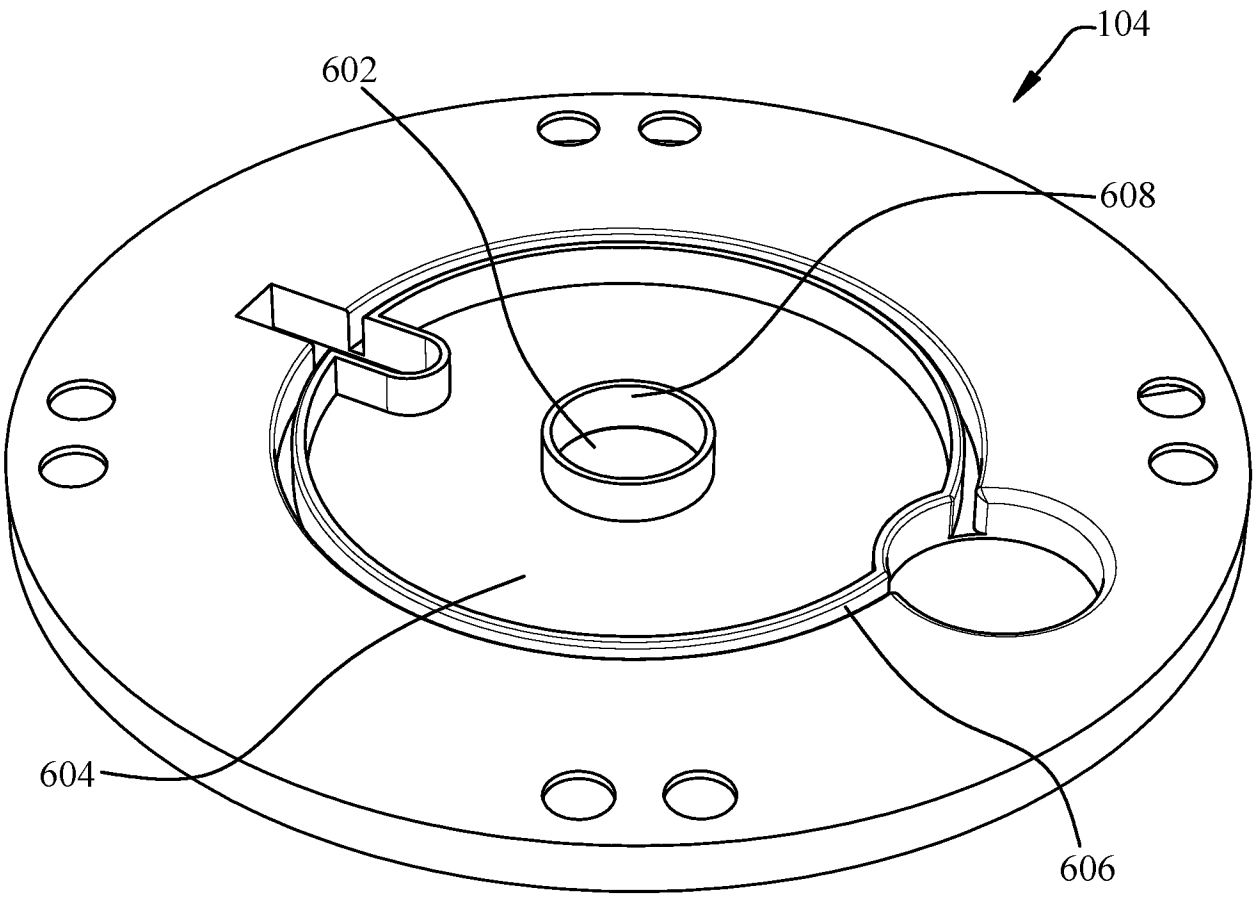
FIG. 6 is a perspective view of a round flange.

FIG. 6 is a perspective view of one of the round flanges 104. Flange 104 comprises a substantially round plate with an engagement hole 602 formed in or near its center. Engagement hole 602 is surrounded by a circular wall 608 having a height that is substantially equal to the distance d between the ridge 404 of a flexible pin 402 and the base of the pin 402 (see FIG. 4*b*). The engagement hole 602 is configured to engage with the flange engagement mechanism 108 of the endplate 102, as will be described in more detail below. Engagement hole 602 resides at or near the center of a round recessed area 604 of the flange 104, which is surrounded by a circular groove 606 that is substantially concentric with the engagement hole 602. This groove 606 is configured to receive the edge of a hollow spool core. Although the illustrated flange 104 depicts groove 606 as being circular, the groove 606 may be another shape to accommodate spools having non-circular profiles.

Figure 7:
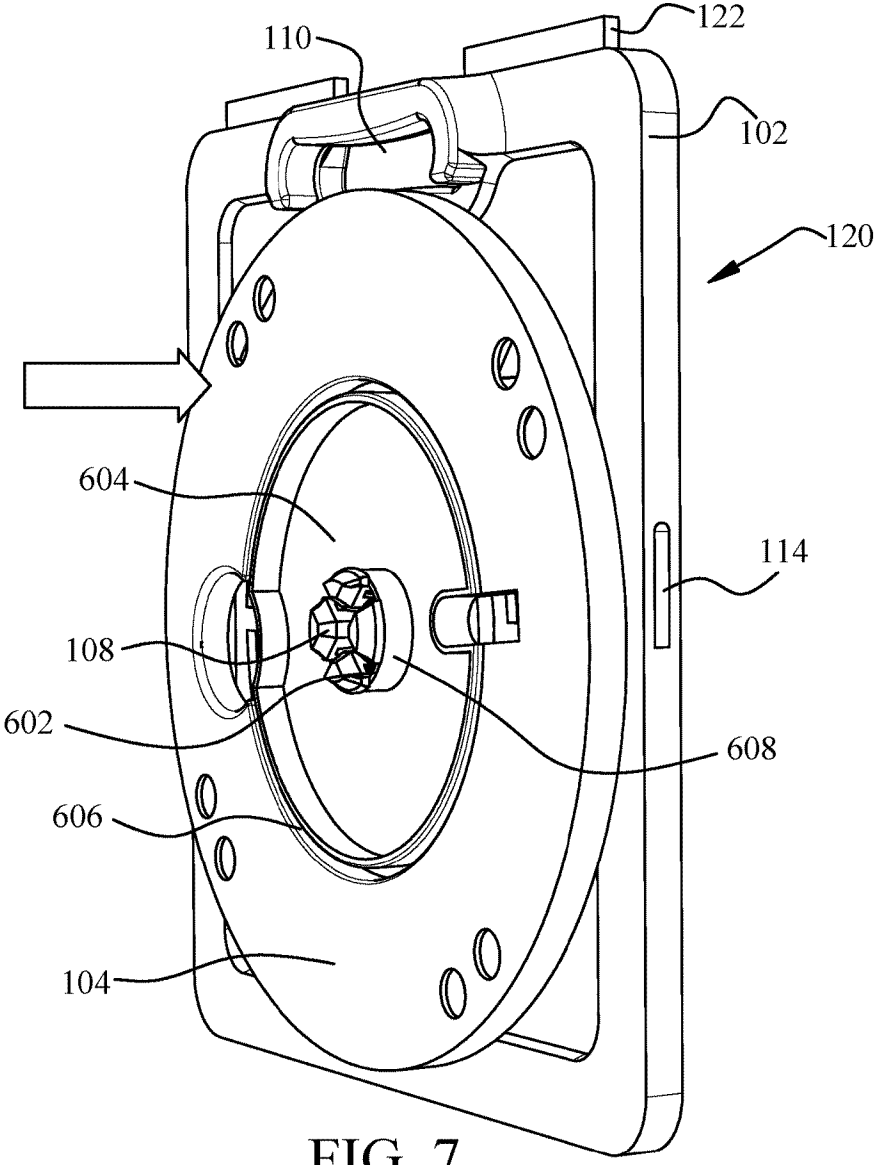
FIG. 7 is a perspective view of the round flange installed on the square endplate to yield an assembly.
Figure 8:
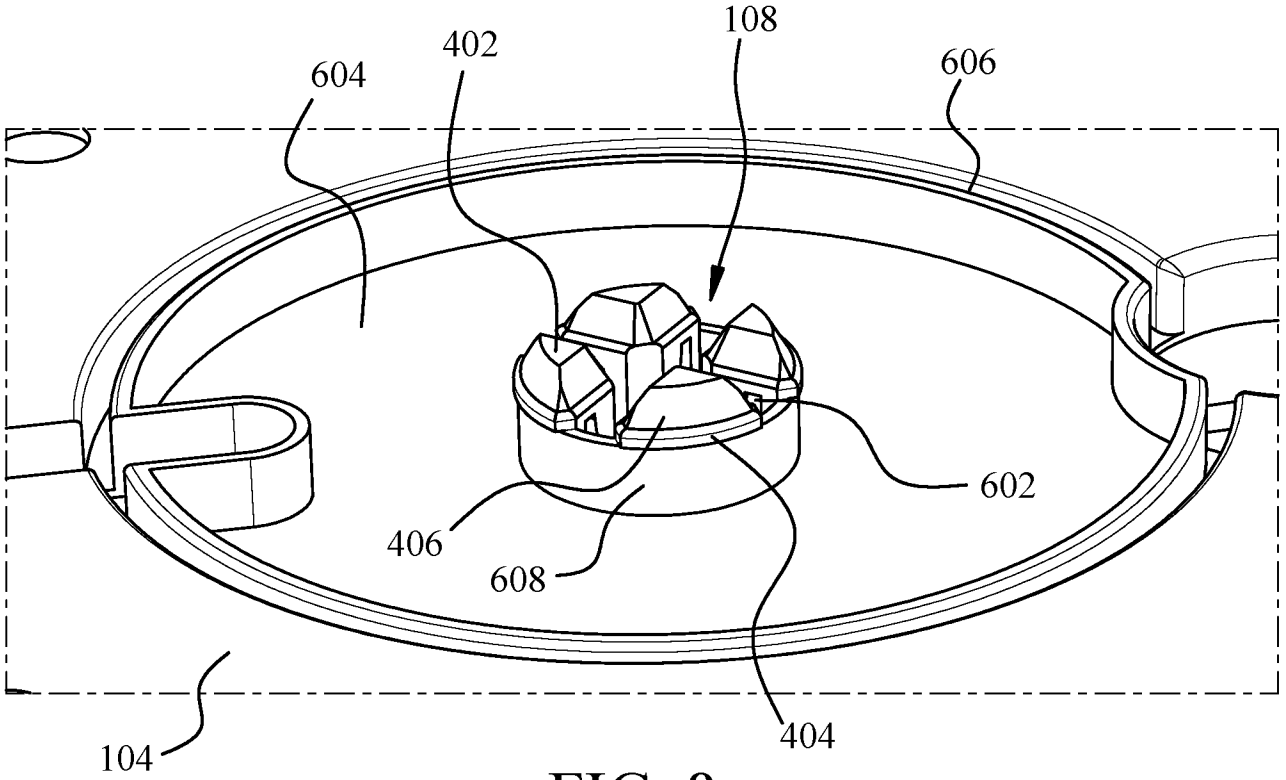
FIG. 8 is a close-up view of the engagement mechanism of the endplate and an engagement hole of the round flange while engaged.

FIG. 7 is a perspective view of the flange 104 installed on the square endplate 102 to yield an assembly 120. Flange 104 can be installed on the endplate 102 by aligning the engagement hole 602 of the flange 104 with the engagement mechanism 108 of the endplate 102 and pushing the flange 104 against the endplate 102 until the engagement mechanism 108 engages with the hole 602. FIG. 8 is a close-up view of the engagement mechanism 108 of the endplate 102 and the engagement hole 602 of the round flange 104 while engaged. As the flange 104 is pushed against the endplate 102 with the engagement hole 602 aligned with the engagement mechanism 108, the interaction between the wall 608 of hole 602 and the slanted upper surfaces 406 of the flexible pins 402 causes the pins 402 to be retracted inward toward the center of the engagement mechanism 108, permitting the engagement mechanism 108 to be inserted through the hole 602 until the raised ridges 404 of the flexible pins 402 pass over the top of wall 608. The outward pressure applied by the flexible pins 402 then causes the ridges 404 to engage with the top edge of the wall 608 such that the ridges 404 retain the flange 104 against the endplate 102.

The design of the engagement mechanism 108, the flange 104, and the endplate 102 permit the flange 104 to rotate about the engagement mechanism 108. The friction caused by the outward pressure applied by the pins 402 against the wall 608 surrounding the hole 602 of the flange 104 acts as a resistive force against excessive freewheeling of the flange 104 and serves as a friction brake while cable is being pulled from the spool 106.

Figure 9:
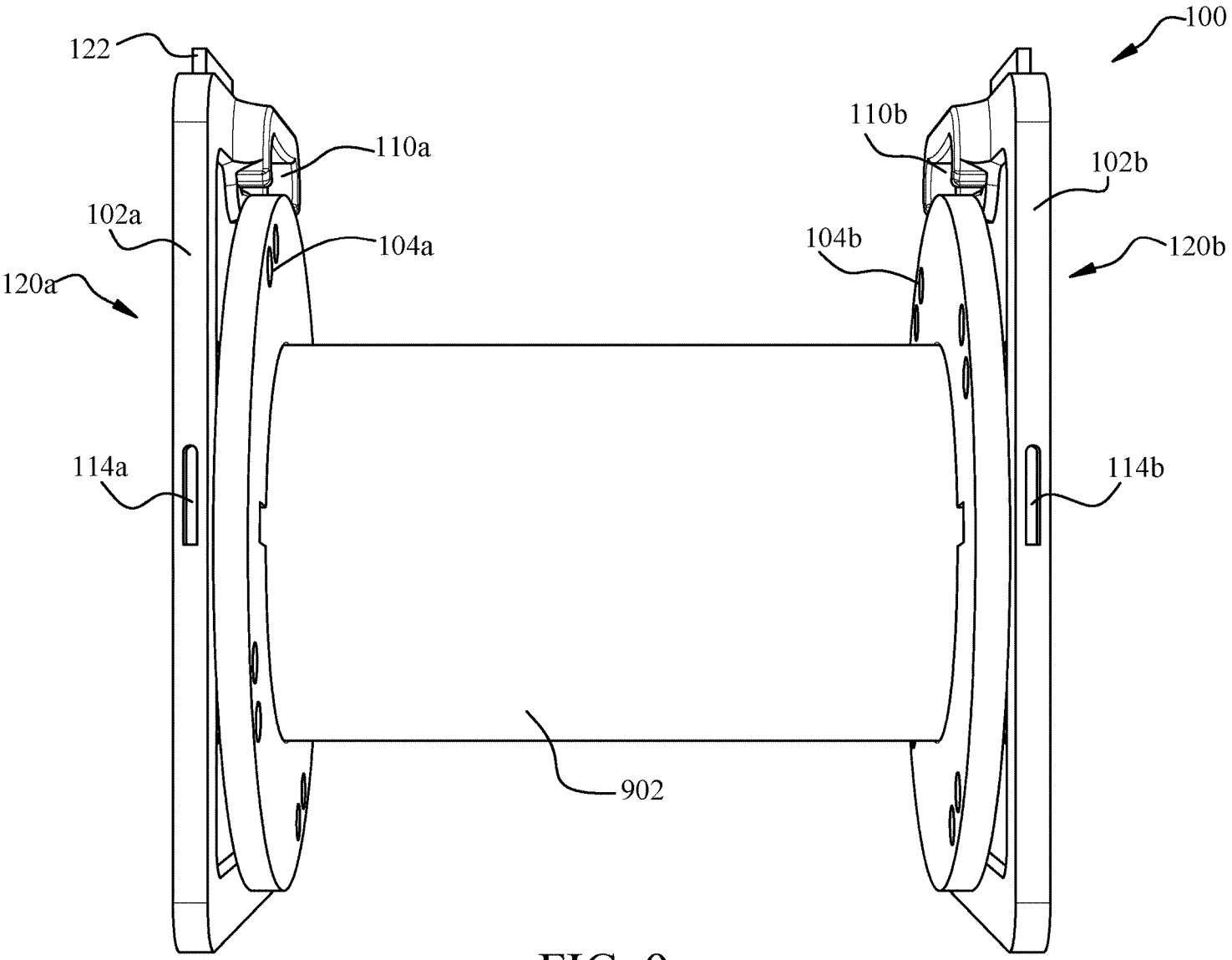
FIG. 9 is a view of a pay off reel comprising a pair of assemblies holding an empty spool core.

The assembly 120 illustrated in FIGS. 7 and 8—comprising a round flange 104 installed on a square endplate 102—can be used in pairs to hold cable spools 106. FIG. 9 is a view of a pay off reel 100 comprising a pair of assemblies 120 holding an empty spool core 902 (the cable is omitted from the core 902 in FIG. 9 for clarity). In this example, the core 902 comprises a hollow cylindrical tube around which cable can be wound. The circular edge of each end of the core 902 can be inserted into the circular groove 606 (see FIGS. 6-8) of one of the round flanges 104*a*, 104*b*, such that the core 902 is held between the two assemblies 120*a*, 120*b*.

FIG. 2 depicts this configuration when cable is wound on the core 902. The square assemblies 120*a*, 120*b* elevate the cable spool 106—comprising the core 902 and wound cable—above the ground to permit the spool 106 to rotate as cable is being pulled. As noted above, while the flanges 104*a*, 104*b* are engaged with the square endplates 102*a*, 102*b*, the flanges 104*a*, 104*b* are permitted to rotate about the engagement mechanism 108, thereby permitting the cable spool 106 to rotate as cable is being pulled. The tight engagement between the flexible pins 402 and the wall 608 surrounding the flange's hole 602 provides a frictional braking force that prevents the spool 106 from freewheeling or backspinning as cable is being pulled, thereby preventing entanglements that may otherwise be caused by uncontrolled cable pay off. The endplates 102*a*, 102*b* can be made of a sturdy material (e.g., rigid plastic) so that the spool 106 is held securely in position and stabilized during cable pay off. The handles 110*a*, 110*b* formed near the top edges of the endplates 102*a*, 102*b* provide handholds that allow installers to easily pick up and move the cable reel 100 assembly.

Figure 10A:
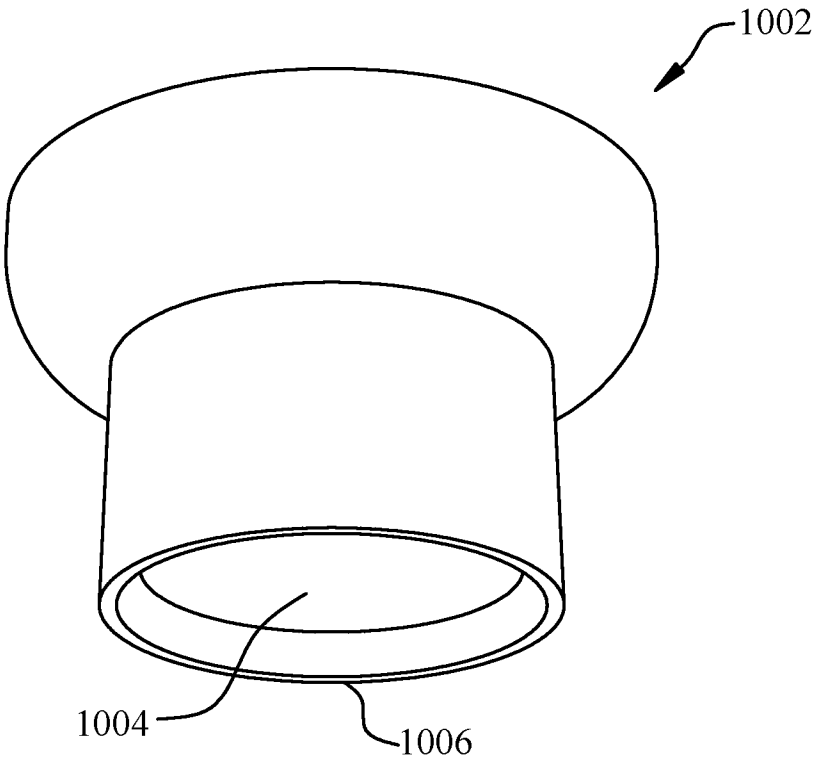
FIG. 10*a* is a perspective view of a disassembly tool.
Figure 10B:
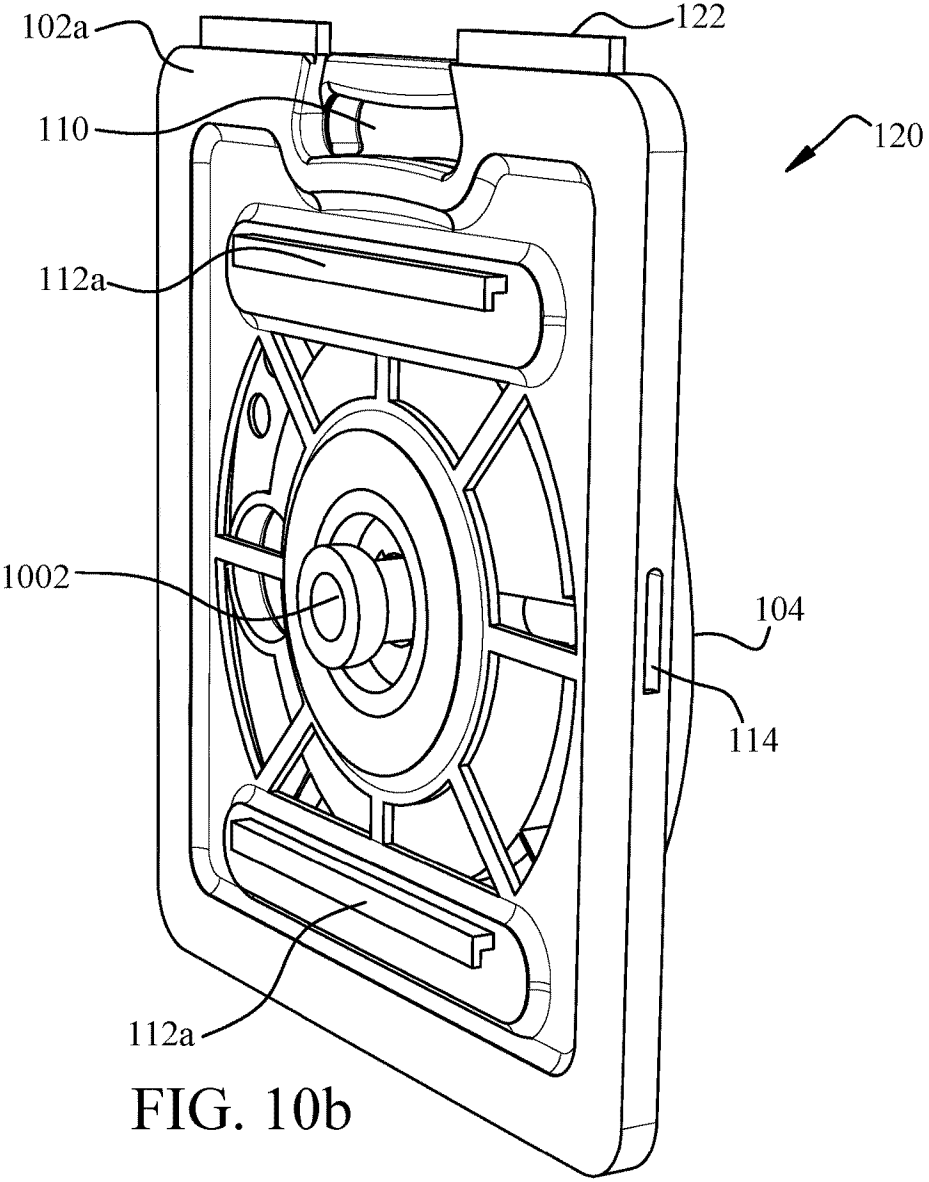
FIG. 10*b* is a perspective view of the assembly of FIG. 7 with a disassembly tool inserted into the engagement mechanism
Figure 11:
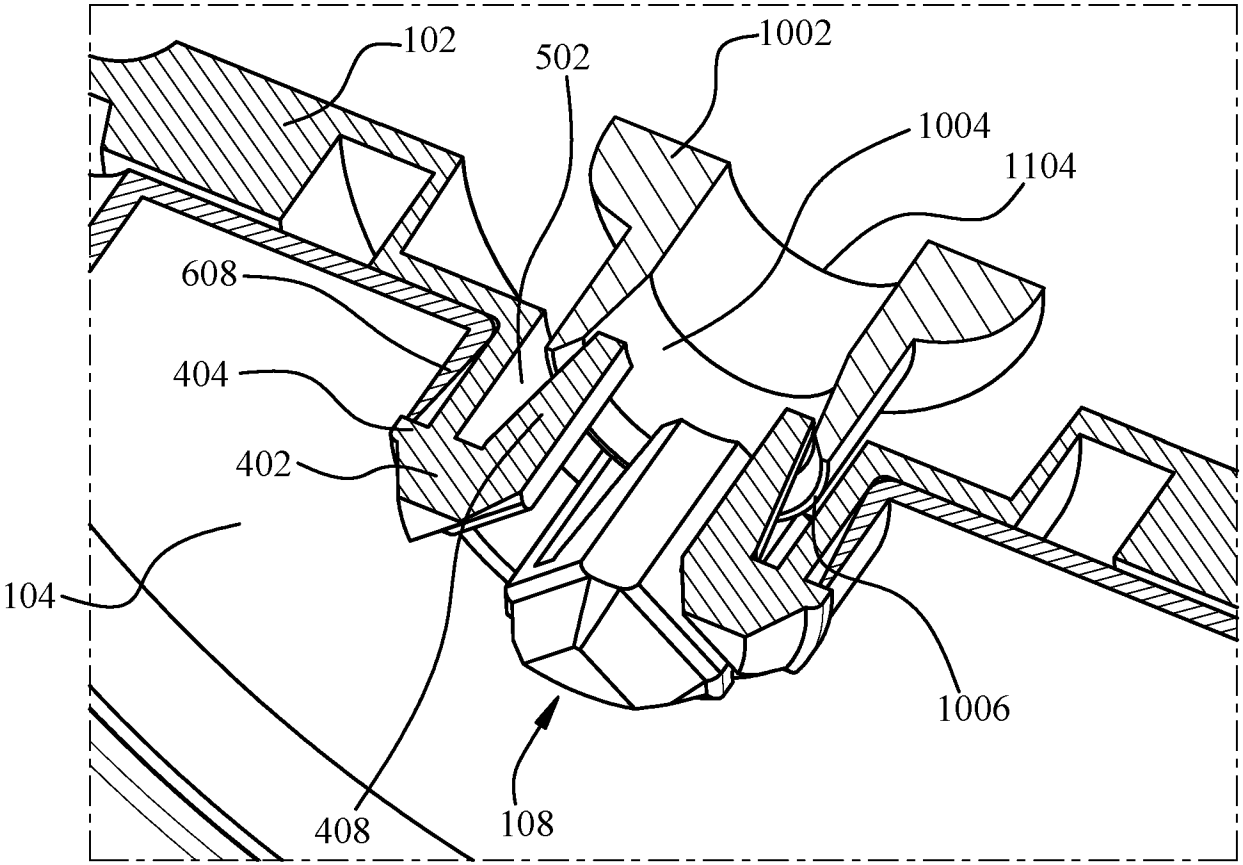
FIG. 11 is a cross-sectional view of the flange and the endplate while the disassembly tool is inserted.

The design of engagement mechanism 108 allows the round flange 104 to be easily disengaged from the square endplate 102 using a disassembly tool. FIG. 10*a* is a perspective view of an example disassembly tool 1002 that can be used to disengage the flange 104 from the square endplate 102. FIG. 10*b* is a perspective view of assembly 120 with the disassembly tool 1002 inserted into the engagement mechanism 108. FIG. 11 is a cross-sectional view of the flange 104 and endplate 102 while the disassembly tool 1002 is inserted. The disassembly tool 1002 has a hollow cylindrical structure. As shown in the cross-sectional view of FIGS. 10*a* and 11, at least a portion of the interior surface 1004 of the tool 1002 near the leading edge 1006 of the tool 1002 (that is, the edge 1006 that inserts into the engagement mechanism 108) slants inward toward the trailing edge 1104 (see FIG. 11) of the inner surface of the tool 1002, such that the interior diameter of the tool 1002 decreases from the leading edge 1006 to a point at least partway toward the trailing edge 1104.

To disengage the flange 104 from the square endplate 102, the leading edge 1006 of the tool 1002 is inserted into the engagement mechanism 108 from the rear side of the endplate 102 as shown in FIGS. 10*b* and 11; that is, the side of the endplate 102 opposite the side on which the flange 104 is mounted. The circular leading edge 1006 of the tool 1002 is inserted into the circular gap 502 formed by the tongues 408 of the flexible pins 402 (see FIG. 5). As the tool 1002 is inserted, the slanted interior surface 1104 of the tool 1002 causes the tongues 408 and their corresponding pins 402 to retract toward the center of the engagement mechanism 108, thereby disengaging the ridges 404 of the pins 402 from the circular wall 608 and allowing the flange 104 to be removed from the square endplate 102.

Figure 12:
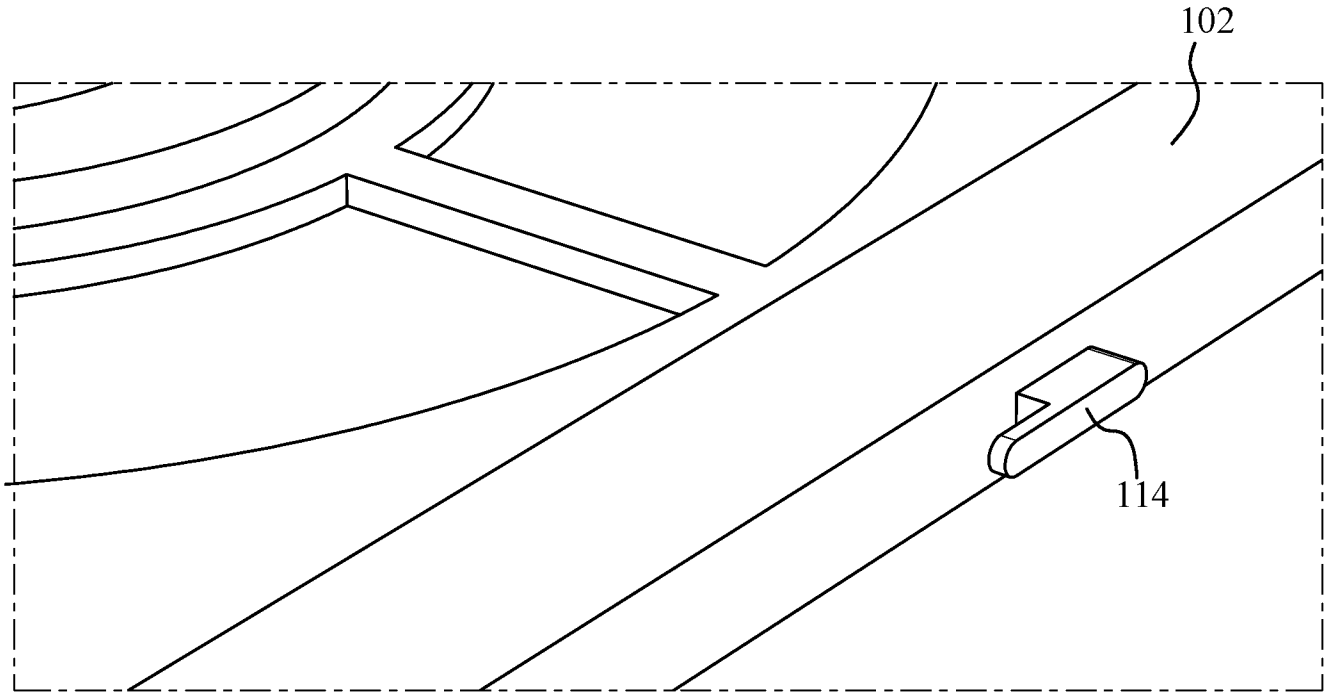
FIG. 12 is a close-up view of an engagement pin formed on a first vertical edge of the endplate.
Figure 13:
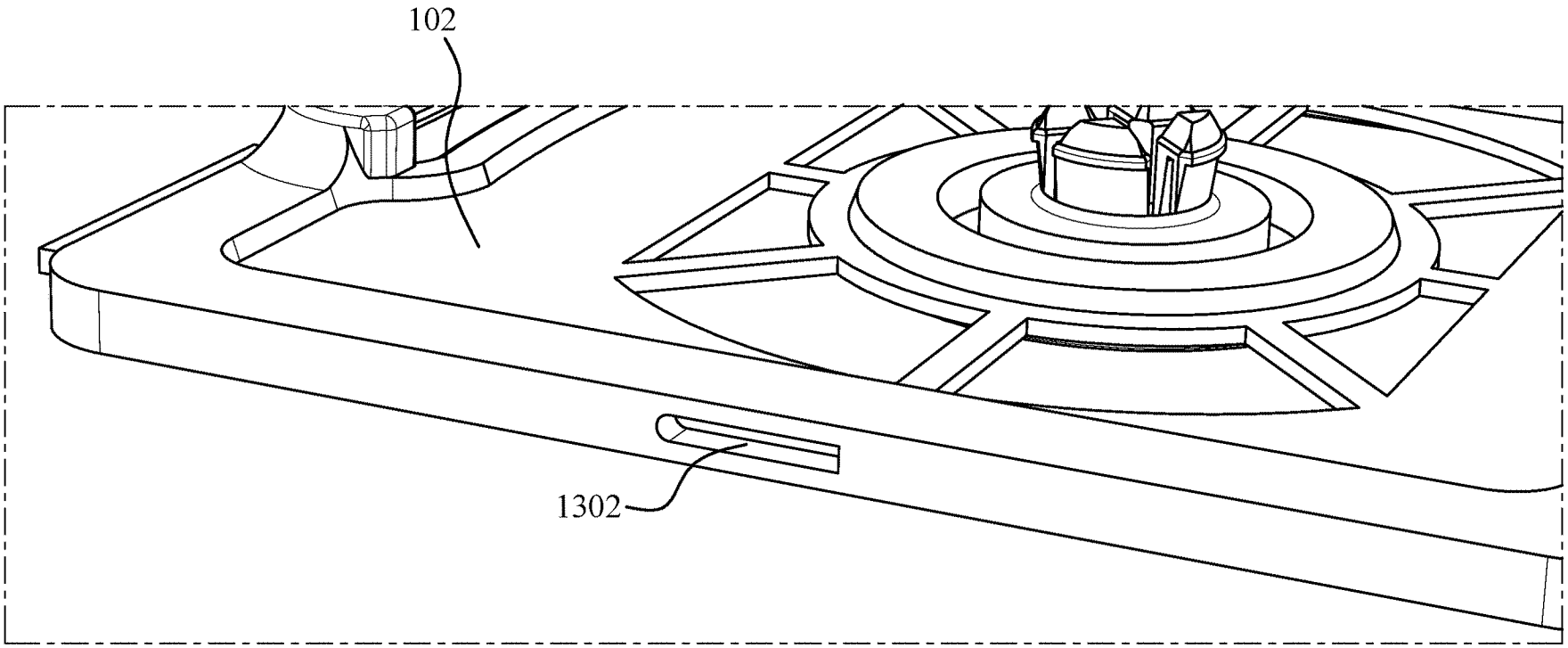
FIG. 13 is a close-up view of an engagement slot formed on a second vertical edge of the endplate opposite the first edge.

Various other engagement mechanisms on the square endplates 102 allow the assembled pay off reel 100 to be interlocked with other pay off reels 100 in the top-to-bottom direction, the side-to-side direction, and the front-to-rear direction. FIGS. 12-14*b* depict front-to-rear engagement of the endplates 102. FIG. 12 is a close-up view of an engagement pin 114 formed on a first vertical or side edge of the endplate 102 (that is, an edge adjacent to the top edge on which the handle 110 is formed). FIG. 13 is a close-up view of a corresponding engagement slot 1302 formed on a second vertical or side edge of the endplate 102 opposite the first edge. Each endplate 102 comprises an engagement pin 114 on its first vertical edge and a slot 1302 on its opposing second vertical edge The engagement pin 114 comprises a downward-facing hook that can be inserted into the corresponding engagement slot 1302 of another endplate 102. A portion of the interior of the endplate 102 surrounding the engagement slot 1302 is hollow, allowing the engagement pin 114 to be hooked into the slot 1302.

Figure 14A:
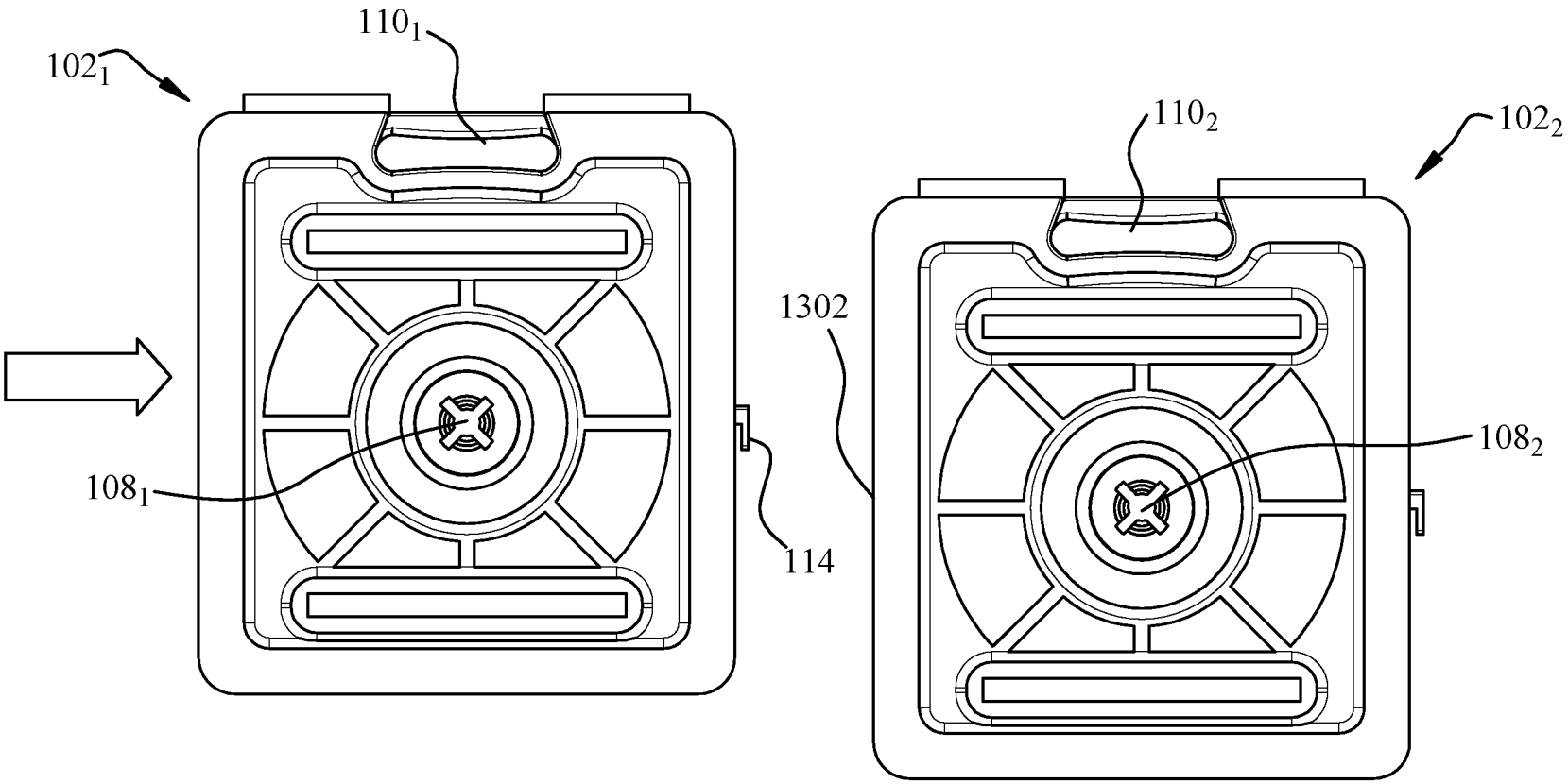
FIG. 14*a* is a view of two endplates aligned prior to a front-to-rear interlocking.
Figure 14B:
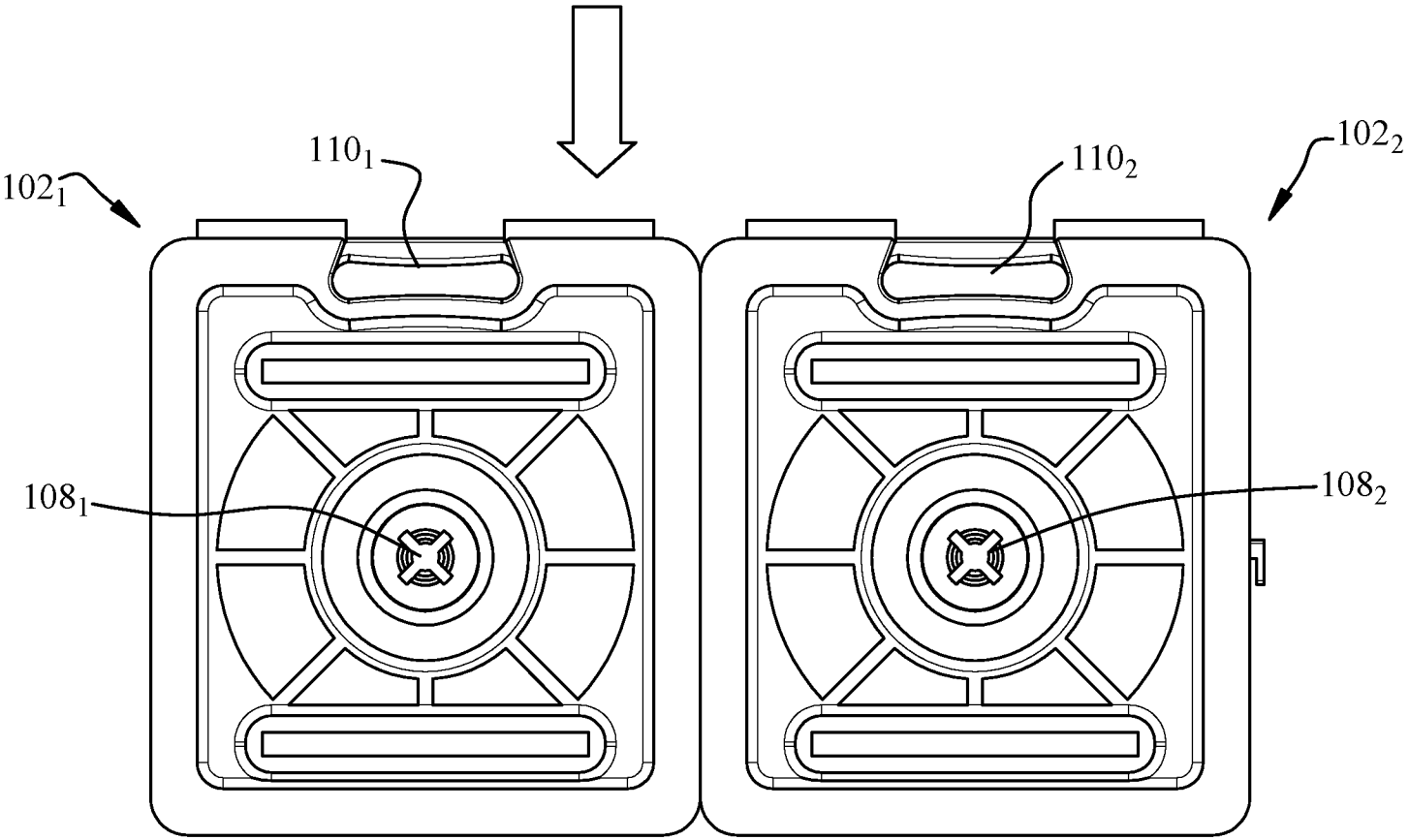
FIG. 14*b* is a view of the two endplates locked together in a front-to-rear interlocking.

FIG. 14*a* illustrates a preliminary alignment of two square endplates $\mathbf{102}_1$ and $\mathbf{102}_2$ prior to a front-to-rear interlocking. In a typical scenario, the two endplates $\mathbf{102}_1$ and $\mathbf{102}_2$ will be components of respective two pay off reels 100; e.g., two left-side endplates 102 or two right-side endplates 102 of respective pay off reels 100. The height of the engagement pin 114 of endplate $\mathbf{102}_1$ is slightly smaller than a length of the slot 1302 of endplate $\mathbf{102}_2$, allowing the pin 114 to be hooked into the slot 1302. In FIG. 14*a*, the first endplate $\mathbf{102}_1$ is positioned to align its engagement pin 114 with the slot 1302 of the second endplate $\mathbf{102}_2$, with the facing edges of the two endplates $\mathbf{102}_1$, $\mathbf{102}_2$ substantially parallel. The positions of the pin 114 and the slot 1302 along their respective endplate edges are such that the first endplate $\mathbf{102}_1$ is elevated slightly relative to the second endplate $\mathbf{102}_2$ when the pin 114 is aligned with the slot 1302. The first endplate $\mathbf{102}_1$ is then pressed against the second endplate $\mathbf{102}_2$ such that the two facing edges are abutted against one another and the engagement pin 114 of endplate $\mathbf{102}_1$ is inserted into the slot 1302 of endplate $\mathbf{102}_2$. The first endplate $\mathbf{102}_1$ is then moved downward relative to the second endplate $\mathbf{102}_2$ to hook the pin 114 into the slot 1302 and lock the two endplates $\mathbf{102}_1$, $\mathbf{102}_2$ together, as shown in FIG. 14*b*. This downward movement causes the pin 114 to hook over the bottom edge of the slot 1302, thereby preventing separation of the endplates $\mathbf{102}_1$, $\mathbf{102}_2$ unless a disengagement sequence is performed. When in this locked position, the top and bottom edges of the endplates $\mathbf{102}_1$, $\mathbf{102}_2$ are substantially flush. To disengage the two endplates $\mathbf{102}_1$, $\mathbf{102}_2$, the first endplate $\mathbf{102}_1$ can be lifted upward relative to the second endplate $102_2$ to disengage the pin 114 and the two endplates $102_1$, $102_2$ can be separated.

Figure 15:
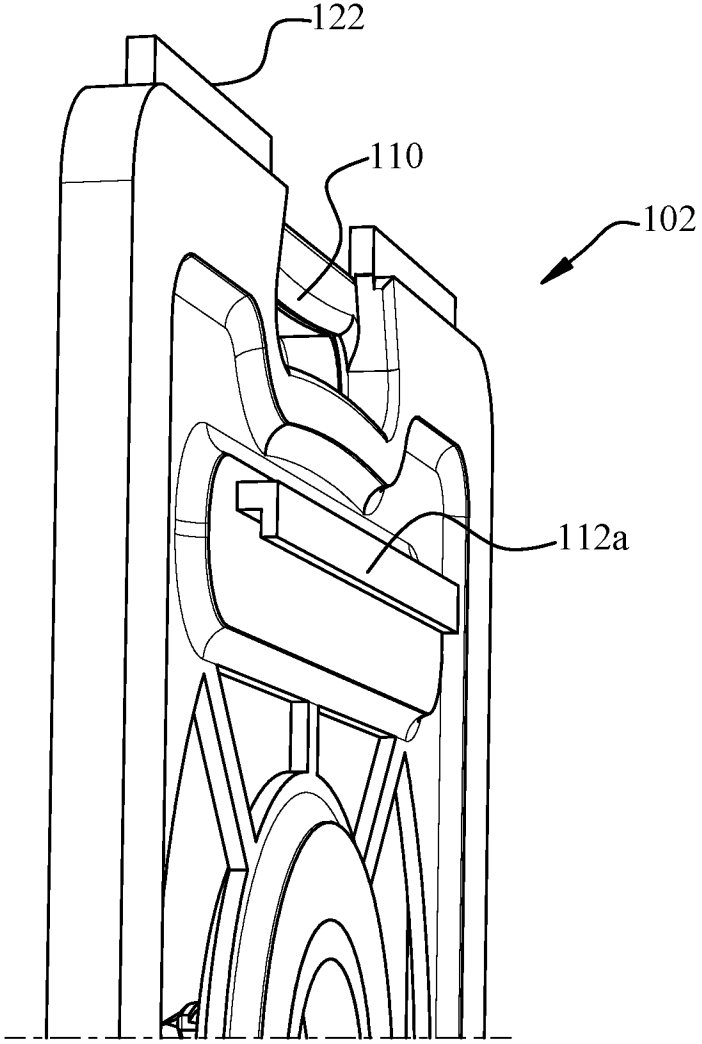
FIG. 15 is a close-up view of a top portion of the rear side of an endplate illustrating a top elongated engagement hook.

FIGS. 15-17*d* depict side-to-side engagement of the endplates 102. FIG. 15 is a close-up view of a top portion of the rear side of an endplate 102 illustrating the top elongated engagement hook 112*a*. Engagement hooks 112*a* and 112*b* are formed on the rear side of some endplates 102 and run substantially parallel with the top and bottom edges of the endplate 102. The engagement hooks 112*a* and 112*b* can be formed near the top and bottom edges, respectively, of the endplate 102 (see, e.g., FIG. 3*c*). Each engagement hook 112 comprises an elongated downward-facing edge that is offset from the rear surface of the endplate 102.

Figure 16:
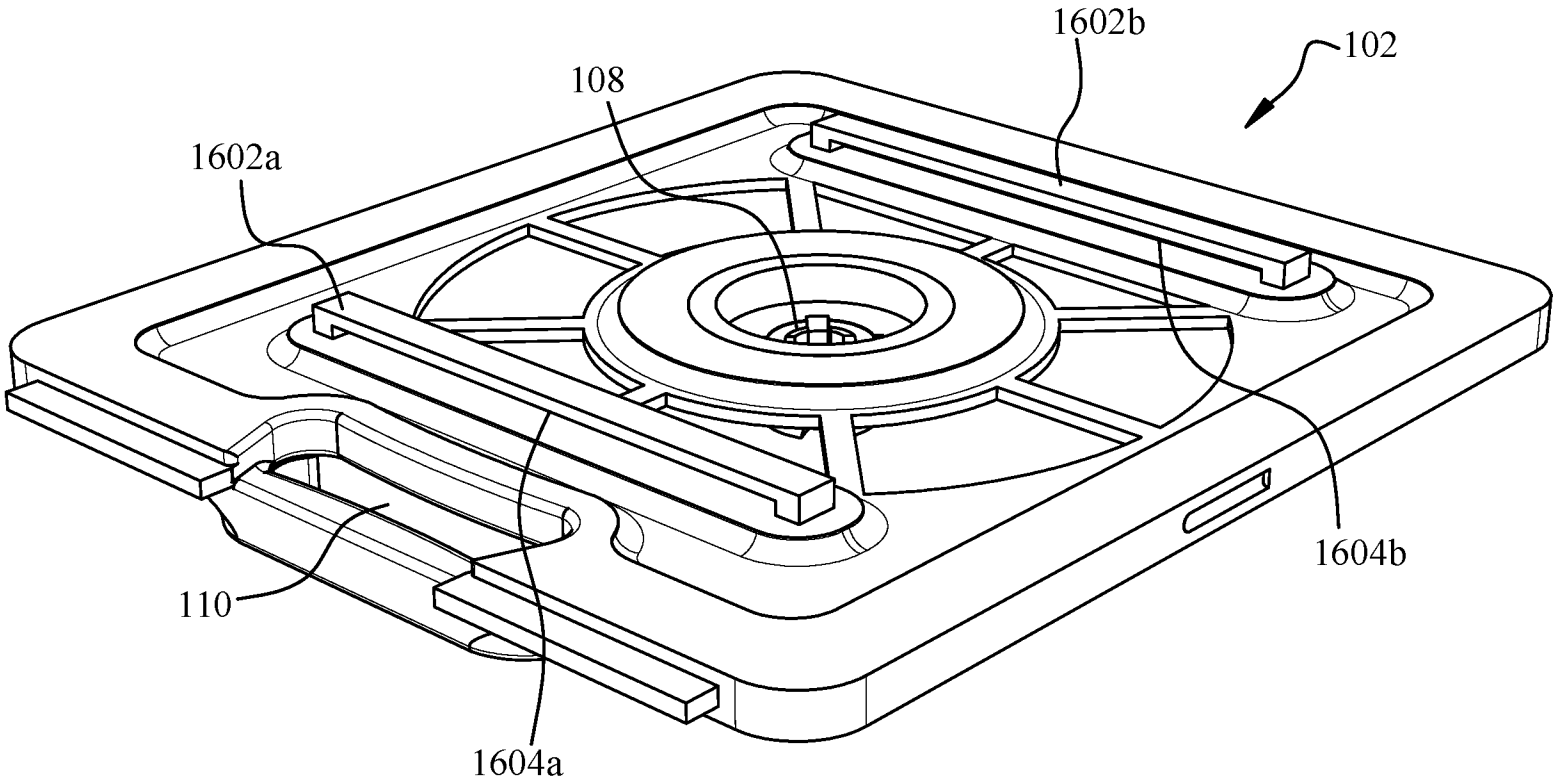
FIG. 16 is a perspective view of an endplate having elongated receptacles formed on its rear side.

Endplates 102 having elongated engagement hooks 112 formed on their rear side are configured to lock together with other endplates 102 that have elongated receptacles formed on their rear side instead of elongated hooks 112. FIG. 16 is a perspective view of an endplate 102 having elongated receptacles 1602*a* and 1602*b* formed on its rear side in place of elongated hooks 112. Similar to hooks 112, the elongated receptacles 1602*a* and 1602*b* can be formed near the top and bottom edges, respectively, of endplate 102, and are substantially parallel with those edges. Each receptacle 1602*a* and 1602*b* comprises an upward-facing pocket 1604*a*, 1604*b* configured to receive a corresponding hook 112 of another endplate 102.

Figure 17A:
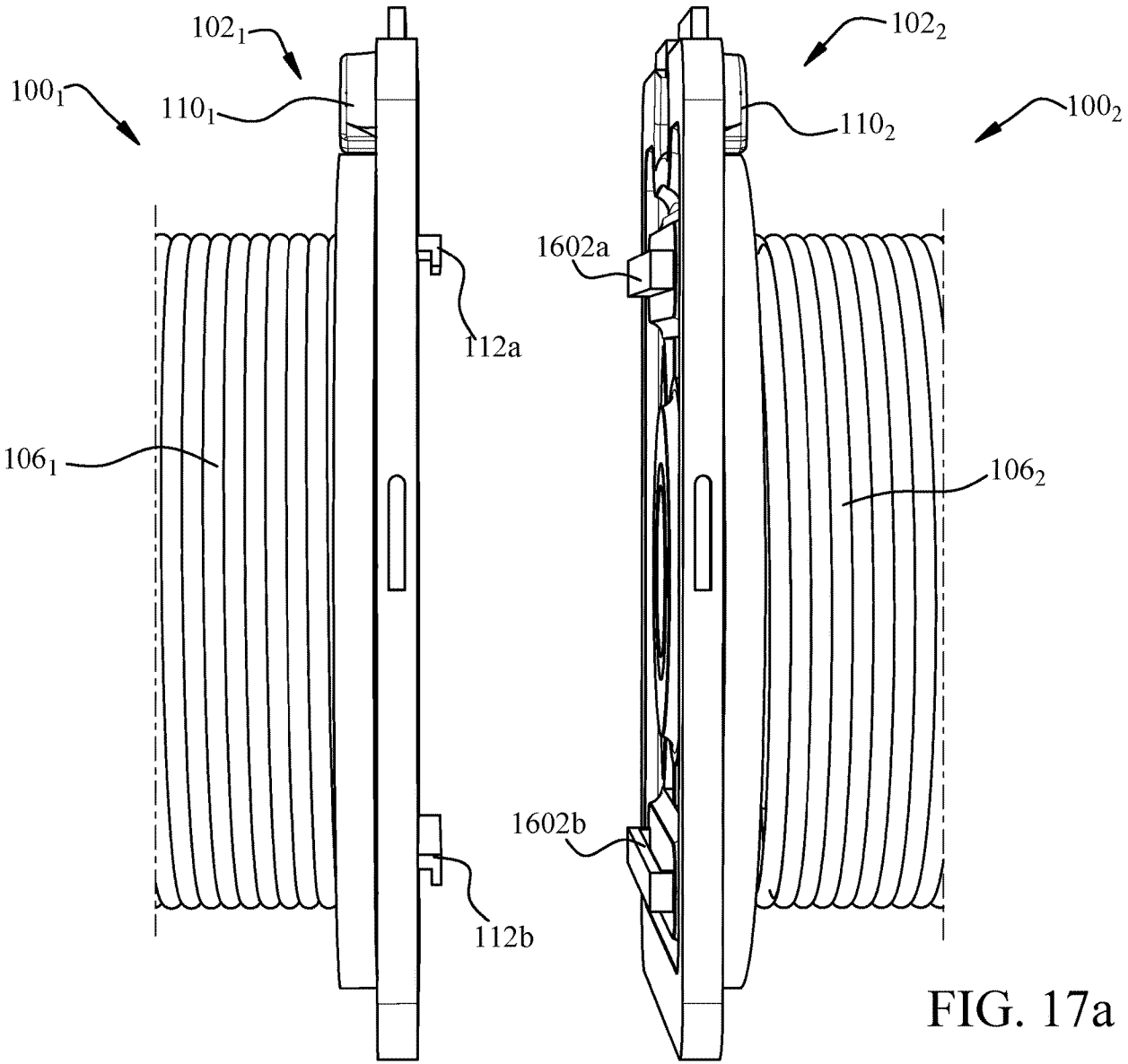
FIG. 17*a* is a side view of two endplates aligned and oriented prior to side-to-side engagement.

FIGS. 17*a*-17*d* illustrate side-to-side engagement of endplates $102_1$ and $102_2$ of respective two pay off reels $100_1$ and $100_2$. FIG. 17*a* is side view of two endplates $102_1$ and $102_2$ aligned and oriented prior to engagement. According to an example assembly system, endplates 102 can be configured with either elongated hooks 112 or elongated receptacles 1602 depending on whether the endplates 102 are intended to serve as the left side or the right side of a pay off reel 100. In the illustrated example, the right-side endplate $102_1$ of reel $100_1$ is configured with engagement hooks 112*a* and 112*b*, while the left-side endplate $102_2$ of reel $100_2$ is configured with engagement receptacles 1602*a* and 1602*b*.

Figure 17C:
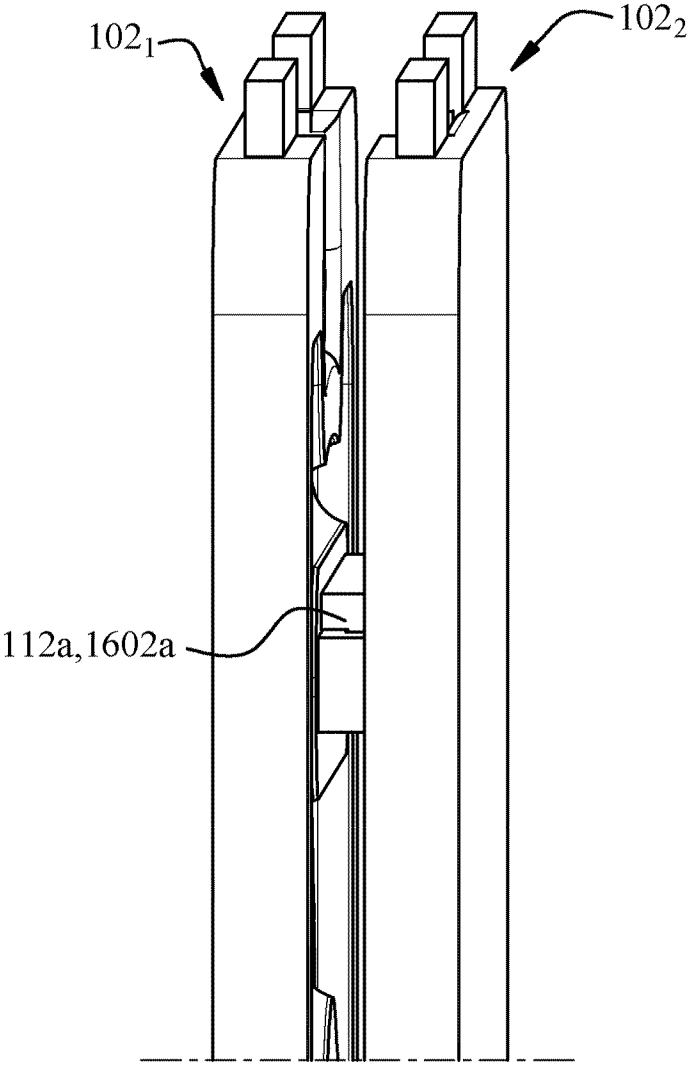
FIG. 17*c* is a close-up view of an engagement hook engaged with an engagement receptacle.
Figure 17B:
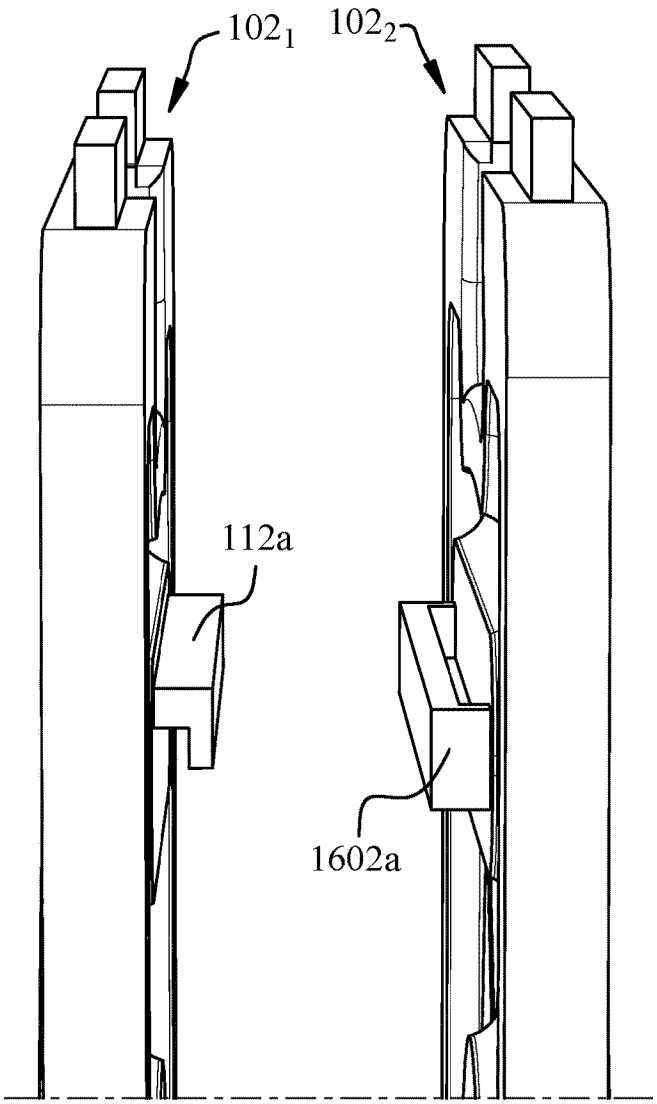
FIG. 17*b* is a close-up view of an engagement hook and an engagement receptacle prior to side-to-side engagement.
Figure 17D:
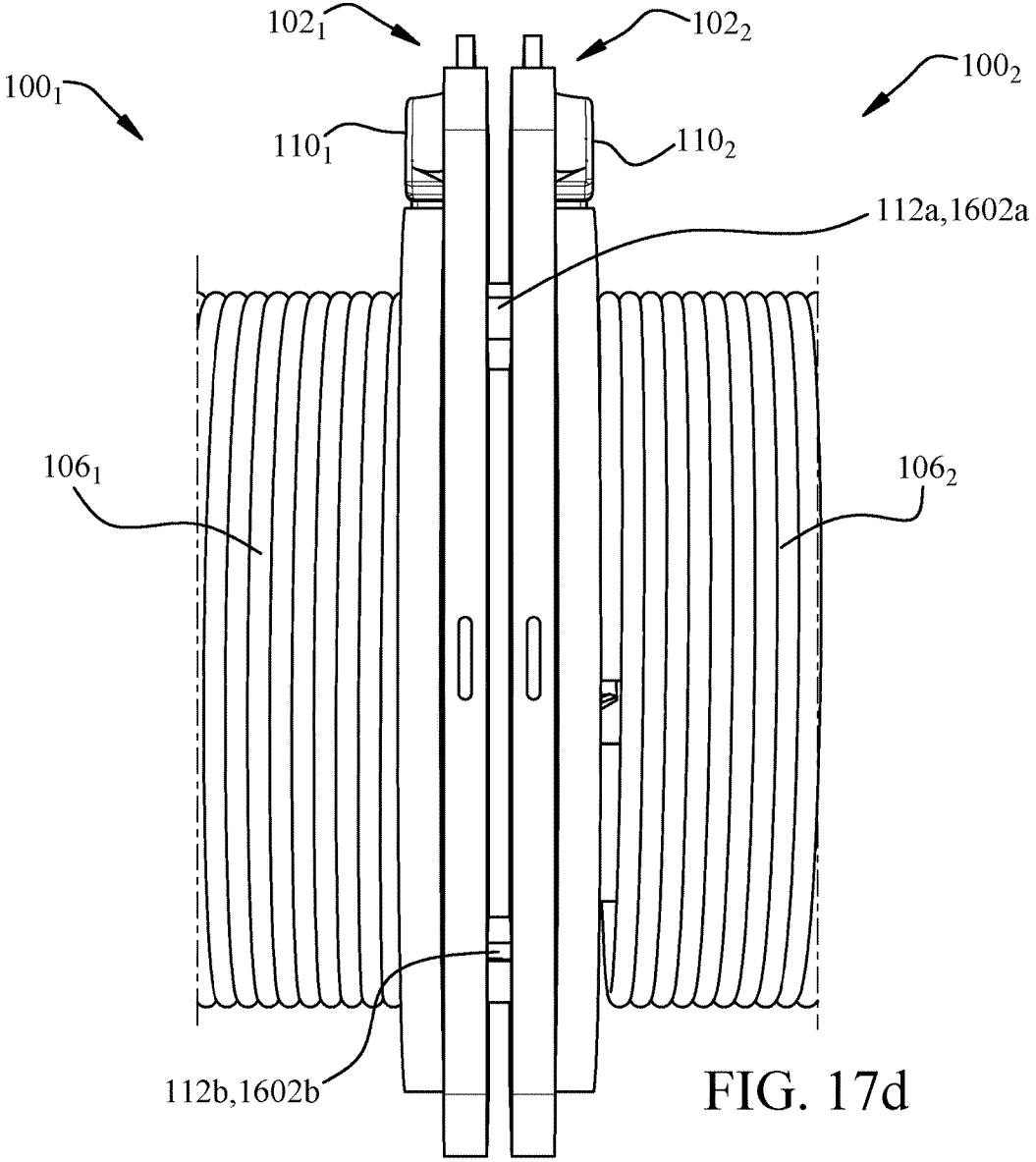
FIG. 17*d* is a side view depicting two pay off reels when locked in a side-to-side arrangement.

FIG. 17*b* is a close-up view of engagement hook 112*a* and engagement receptacle 1602*a* prior to engagement, and FIG. 17*c* is a close-up view of engagement hook 112*a* engaged with engagement receptacle 1602*a*. To lock the two endplates $102_1$ and $102_2$, the downward-facing edges of hook 112*a* and 112*b* are inserted into the upward-facing pockets of receptacles 1602*a* and 1602*b*, respectively. FIG. 17*d* depicts the two pay off reels $100_1$ and $100_2$ when locked in a side-to-side arrangement. To disengage the reels $100_1$ and $100_2$, a user can lift the pay off reel $100_1$ to remove the hooks 112*a* and 112*b* from the receptacles 1602*a* and 1602*b*.

Figure 18:
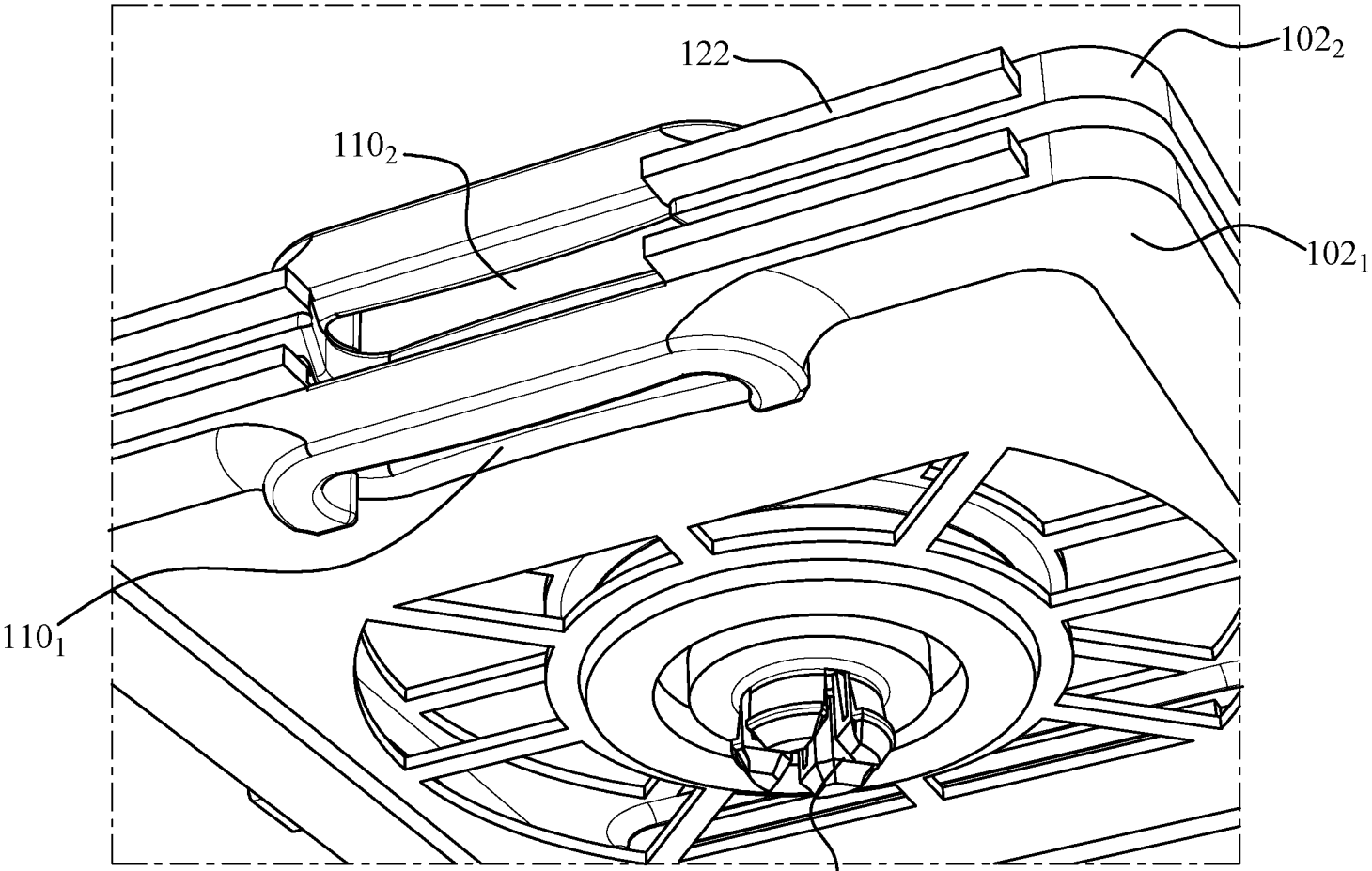
FIG. 18 is a close-up view of two endplates illustrating spacing between the endplates' handles while the endplates are engaged.

FIG. 18 is a close-up view of the two endplates $102_1$ and $102_2$ illustrating the spacing between the handles $110_1$ and $110_2$ while the endplates $102_1$ and $102_2$ are engaged. As shown in this figure, the design of endplates $102_1$ and $102_2$ maintains a spacing between the handles $110_1$ and $110_2$ while the two endplates $102_1$ and $102_2$ are connected in a side-to-side engagement. This allows a user to insert his or her hands between the handles $110_1$ and $110_2$ while lifting one of the pay off reels 100 (e.g., to disengage endplate $102_1$ from endplate $102_2$).

Figure 19:
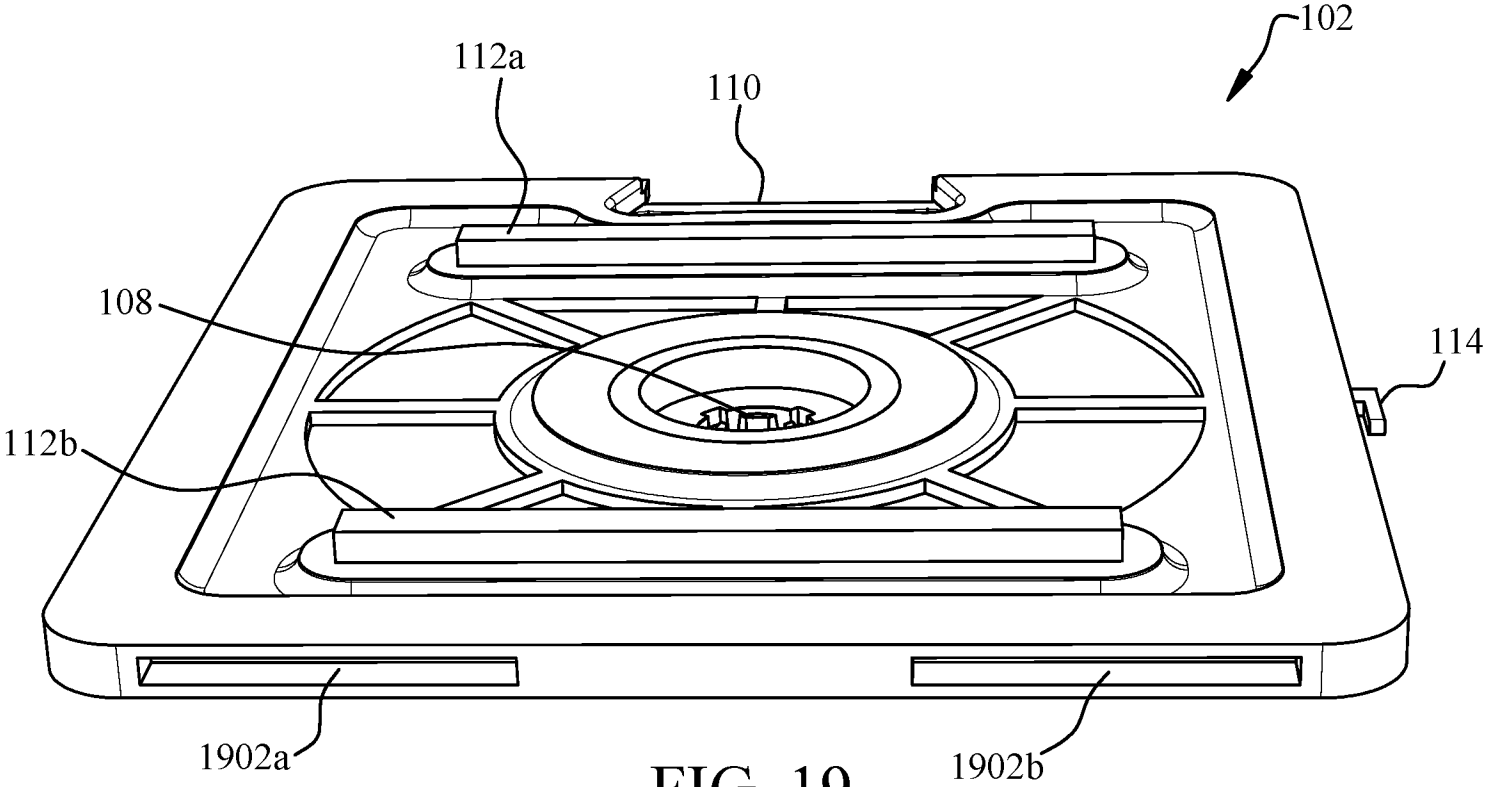
FIG. 19 is a perspective view of an endplate showing the engagement slots formed along the bottom edge of the endplate.
Figure 20:
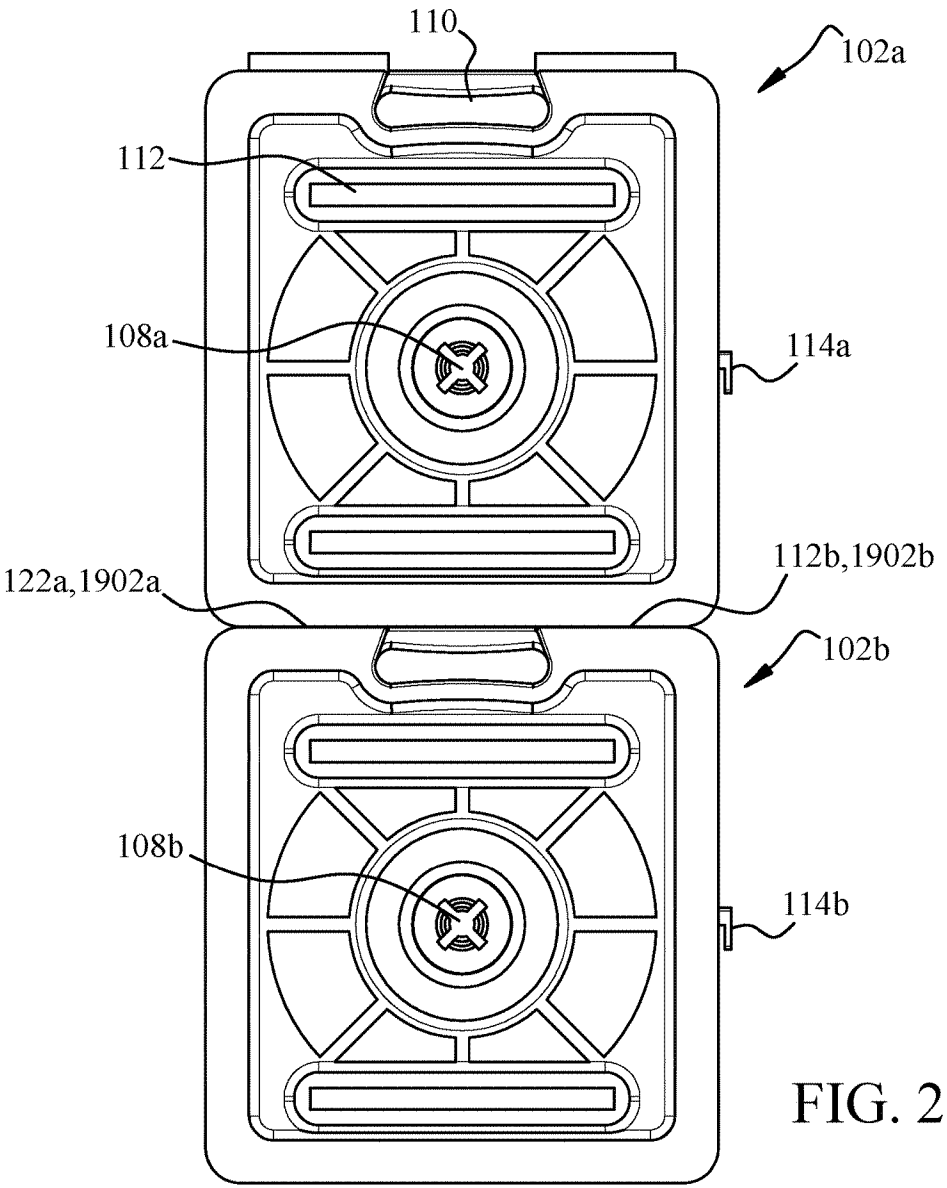
FIG. 20 is a rear view of two endplates stacked together in a top-to-bottom arrangement.

In addition to supporting front-to-rear engagement and side-to-side engagement of reels 100, the endplates 102 are also configured to support top-to-bottom engagement. To this end, two locking tabs 122*a* and 122*b* (see, e.g., FIGS. 3*a*-3*c*) are formed on the top edge of the endplate 102. These locking tabs 122*a* and 122*b* are configured to insert into corresponding slots 1902 formed on a top edge of another endplate 102. FIG. 19 is a perspective view of an endplate 102 showing the two engagement slots 1902*a* and 1902*b* formed on the bottom edge of the endplate 102. FIG. 20 is a rear view of two endplates 102*a* and 102*b* stacked together in a top-to-bottom arrangement. While stacked in this manner, the engagement tabs 122*a*, 122*b* of the bottom endplate 102*b* are received in the engagement slots 1902*a*, 1902*b* of the top endplate 102*a*. When these endplates 102*a*, 102*b* are components of respective pay off reels 100, the engagement of the tabs 122*a*, 122*b* and slots 1902*a*, 1902*b* prevent sliding of the reels 100 while stacked in a top-to-bottom formation.

Figure 21:
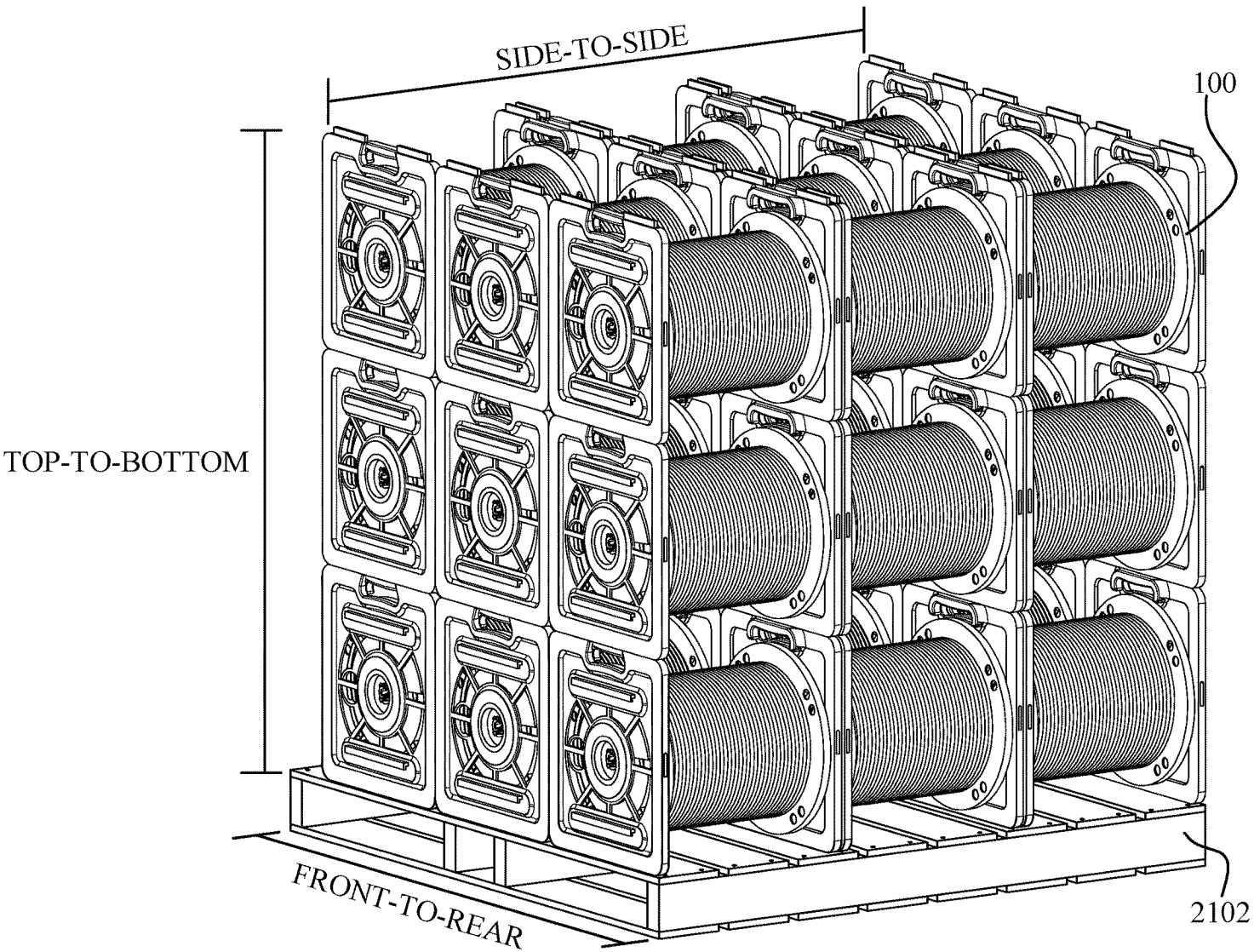
FIG. 21 is a perspective view of a three-dimensional array of pay off reels stacked on a skid.

The engagement features of the pay off reel components described herein allow pay off reels 100 to be stacked in three directions while maintaining stability of each reel. FIG. 21 is a perspective view of a three-dimensional array of pay off reels 100 stacked on a skid 2102. As illustrated in this figure, reels 100 can be simultaneously locked together in side-to-side, top-to-bottom, and front-to-rear directions. Although FIG. 21 depicts 27 reels 100 arranged in a 3×3×3 configuration, reels 100 can be stacked in any number of layers in any of the three directions.

When the reels 100 are stacked in this manner, the cable spools are oriented such that cable can be pulled from any of the reels 100 without removing the reels 100 from the skid 2102, making the reels 100 ready for use directly from the skid 2102 if desired. The rigid square endplates 102 maintain separation between the spools for pay off, and the assemblies 120 that make up the reels 100 (see FIG. 7) permit rotation of the spools during pay off while maintaining a frictional braking force that prevents excessive freewheeling or backspinning. The locking mechanisms described above prevent slipping between the reels in all directions, ensuring stability of the stack while cable is being pulled.

The pay off reel design described herein offers benefits over other types of reels. If the reel 100 is placed on the ground, the rigid square endplates 102 elevate the cable spools 106 off the ground and offer stabilization while cable is being pulled from the spool 106. The interlocking mechanisms that permit the reels 100 to be locked together in three directions can allow a wall or skid of reels 100 to be built as shown in FIG. 21, and the resulting structure orients the spools 106 such that cable can be pulled from any spool 106 while the reels 100 are locked together. The engagement mechanism between the round flanges 104 and the endplates 102 permit rotation of the spool while cable is being pulled while also providing sufficient frictional braking force to prevent cable entanglement due to freewheeling or backspinning. Moreover, the modular design of reels 100—whereby flanges 104 can be removably engaged with square endplates 102—allow these components to be reused with other reel assemblies 120 as needed. Moreover, the uncomplicated assembly workflow offered by this modular design can simplify the process of manufacturing the reels 100 in the factory. The simple reel assembly process can be easily automated if desired, reducing the amount of manual assembly required in the factory.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A cable reel, comprising:

a flange comprising an engagement hole and a groove configured to hold an end of a cable spool; and an endplate having a substantially square or rectangular shape, wherein the endplate comprises an engagement mechanism on a side of the endplate and comprising flexible pins arranged in a circular formation, and insertion of the engagement mechanism through the engagement hole causes the engagement pins to hold the flange on the endplate while permitting rotation of the flange about the engagement mechanism.

2. The cable reel of claim 1, wherein a wall is formed around the engagement hole, the flexible pins comprise respective raised ridges on respective outward-facing surfaces of the flexible pins, and the raised ridges are configured to engage with an edge of the wall while the engagement mechanism is inserted in the engagement hole.

3. The cable reel of claim 2, wherein the flexible pins are angled away from a center of the engagement mechanism while in a relaxed state, and the flexible pins are configured to apply pressure to the wall while the engagement mechanism is inserted in the engagement hole.

4. The cable reel of claim 2, wherein the side of the endplate is a first side, and insertion of a disassembly tool into the engagement mechanism via a second side of the endplate that is opposite the first side causes the raised ridges to disengage from the edge of the wall.

5. The cable reel of claim 4, wherein the flexible pins comprise respective tongues that engage with the disassembly tool as the disassembly tool is inserted into the engagement mechanism, and engagement between the tongues and the disassembly tool causes the flexible pins to retract toward a center of the engagement mechanism.

6. The cable reel of claim 1, wherein the endplate further comprises a hook on a first side edge of the endplate, the hook is configured to engage with a slot on a second side edge of another endplate, and engagement of the hook with the slot locks the first side edge of the endplate with the second side edge of the other endplate.

7. The cable reel of claim 1, wherein the side of the endplate is a first side, the endplate further comprises an elongated hook on a second side of the endplate that is opposite the first side, the elongated hook is configured to engage with an elongated receptacle on a third side of another endplate, and engagement of the elongated hook with the elongated receptacle locks the second side of the endplate with the third side of the other endplate.

8. The cable reel of claim 7, wherein the endplate further comprises a first handle on a first top edge of the endplate, and the endplate maintains a spacing between the first handle and a second handle on a second top edge of the other endplate while the second side of the endplate is locked with the third side of the other endplate.

9. The cable reel of claim 1, wherein the endplate further comprises an engagement tab on a top edge of the endplate and a first slot on a bottom edge of the endplate, and the engagement of the endplate is configured to engage with a second slot on a bottom edge of another endplate.

10. A system, comprising:

a flange comprising a groove configured to hold an end of a cable spool; and an endplate comprising an engagement mechanism configured to hold the flange and to permit rotation of the flange about the engagement mechanism, wherein the endplate has a substantially square or rectangular shape, and the engagement mechanism comprises flexible pins arranged in a circular formation and configured to engage with an engagement hole formed on the flange.

11. The system of claim 10, wherein ridges are formed on respective outward-facing surfaces of the flexible pins, and the ridges are configured to engage with a wall formed around the engagement hole formed on the flange.

12. The system of claim 11, wherein the flexible pins are angled outward from a center of the engagement mechanism while in an unflexed state, and the flexible pins apply a frictional force against the wall while the flange is held by the engagement mechanism.

13. The system of claim 11, wherein the engagement mechanism is formed on a first side of the endplate, and the engagement mechanism is configured to disengage from the flange in response to insertion of a disassembly tool into the engagement mechanism through a second side of the endplate that is opposite the first side.

14. The system of claim 13, wherein the insertion of the disassembly tool causes the flexible pins to retract toward a center of the engagement mechanism via interaction between the disassembly tool and tongues formed on the flexible pins.

15. The system of claim 10, wherein the endplate is a first endplate, a hook is formed on a first side edge of the first endplate, the hook is configured to hook into a slot formed on a second side edge of a second endplate.

16. The system of claim 10, wherein the endplate is a first endplate, an elongated hook is formed on a first side of the endplate that is opposite a second side of the endplate on which the engagement mechanism is formed, and the elongated hook is configured to hook into an elongated receptacle formed on a third side of a second endplate.

17. The system of claim 16, wherein a first handle is formed on a top edge of the first endplate, and the first endplate maintains a spacing between the first handle and a second handle formed on a top edge of the second endplate while the first endplate and the second endplate are locked together by the elongated hook and the elongated receptacle.

18. A cable reel, comprising:

a first assembly comprising a first flange connected to a first endplate by a first engagement mechanism formed on the first endplate;

a second assembly comprising a second flange connected to a second endplate by a second engagement mechanism formed on the second endplate;

wherein the first flange and the second flange comprise respective grooves that are configured to hold respective ends of a cable spool, the first endplate and the second endplate have a substantially square or rectangular shape, and the first engagement mechanism and the second engagement mechanism comprise flexible pins arranged in a circular formation and configured to engage with a first engagement hole and a second engagement hole of the first flange and the second flange, respectively, and to permit rotation of the first flange and the second flange about the first engagement mechanism and the second engagement mechanism.

19. The cable reel of claim 18, wherein the first endplate and the second endplate comprise first engagement hooks on outward-facing surfaces of the first endplate and the second endplate configured to lock the cable reel to another cable reel in a side-to-side direction, second engagement hooks on side edges of the first endplate and the second endplate configured to lock the cable reel to another cable reel in a front-to-rear direction, and engagement tabs on top edges of the first endplate and the second endplate configured to lock the cable reel to another cable reel in a top-to-bottom direction.

20. The cable reel of claim 18, wherein

The first endplate further comprises a hook on a first side edge of the first endplate, the hook is configured to engage with a slot on a second side edge of a third endplate, and engagement of the hook with the slot locks the first side edge of the first endplate with the second side edge of the third endplate.

* * * * *